US008549763B2

(12) United States Patent
Krawchuk

(10) Patent No.: US 8,549,763 B2
(45) Date of Patent: Oct. 8, 2013

(54) SYSTEM AND METHOD FOR GARMENT FITTING AND FABRICATION

(76) Inventor: Tamara Krawchuk, Edmonton (CA)

( * ) Notice: Subject to any disclaimer, the term of this patent is extended or adjusted under 35 U.S.C. 154(b) by 364 days.

(21) Appl. No.: 12/968,724

(22) Filed: Dec. 15, 2010

(65) Prior Publication Data

US 2012/0156962 A1 Jun. 21, 2012

(51) Int. Cl.
*A41H 3/01* (2006.01)
*A41H 3/04* (2006.01)

(52) U.S. Cl.
USPC ..... 33/17 R; 2/243.1

(58) Field of Classification Search
USPC ..... 33/17 R; 2/243.1
See application file for complete search history.

(56) References Cited

U.S. PATENT DOCUMENTS

| | | | | | |
|---|---|---|---|---|---|
| 2,180,180 | A | | 11/1939 | Versoy | |
| 2,222,687 | A | | 11/1940 | Rosenthal et al. | |
| 2,283,108 | A | | 5/1942 | Versoy | |
| 2,406,699 | A | | 8/1946 | Lustig | |
| 2,553,225 | A | | 5/1951 | Weaver et al. | |
| 2,775,767 | A | | 1/1957 | Gould | |
| 2,858,832 | A | | 11/1958 | Loeffel et al. | |
| 2,863,152 | A | | 12/1958 | Blatt | |
| 3,261,359 | A | | 7/1966 | Gould | |
| 3,339,554 | A | | 9/1967 | Nobbs | |
| 3,431,913 | A | | 3/1969 | Bugnon et al. | |
| 3,939,565 | A | * | 2/1976 | Bush | 33/17 R |
| 3,979,831 | A | * | 9/1976 | Lutz | 33/17 R |
| 4,136,452 | A | * | 1/1979 | McMillan | 33/17 R |
| 4,205,446 | A | * | 6/1980 | Gibson | 33/12 |
| 4,293,959 | A | * | 10/1981 | Gioello | 2/243.1 |
| 4,444,191 | A | | 4/1984 | Harned | |
| 4,860,900 | A | * | 8/1989 | Forschner | 206/574 |
| 4,868,990 | A | | 9/1989 | Steinberg | |
| 4,885,844 | A | * | 12/1989 | Chun | 33/15 |
| 5,215,494 | A | | 6/1993 | Flanagan | |
| 5,378,192 | A | | 1/1995 | Darmante | |
| 5,548,519 | A | | 8/1996 | Park et al. | |
| 5,603,653 | A | | 2/1997 | Hartman | |
| 5,762,535 | A | | 6/1998 | Nishiyama et al. | |
| 5,768,135 | A | | 6/1998 | Park et al. | |
| 5,873,768 | A | * | 2/1999 | Fleischman-Ament et al. | 450/19 |
| 5,908,346 | A | | 6/1999 | McCall | |
| 5,992,027 | A | * | 11/1999 | Mack | 33/12 |
| 6,023,785 | A | | 2/2000 | Johnson | |
| 6,101,424 | A | | 8/2000 | Sawada | |

(Continued)

FOREIGN PATENT DOCUMENTS

| | | | |
|---|---|---|---|
| AU | 2009208143 | A1 | 3/2010 |
| EP | 0649608 | A1 | 4/1995 |

(Continued)

OTHER PUBLICATIONS

Ashdown, S.P. and Na, H. (2008) Comparison of 3-D body scan data to quantify upper-body postural variation in older and younger women. Clothing & Textiles Research Journal 26(4):292-307.

(Continued)

*Primary Examiner* — Christopher Fulton
(74) *Attorney, Agent, or Firm* — Bennett Jones LLP

(57) ABSTRACT

A system for garment fitting and fabrication includes a fabric template and fabric pieces attachable to the template to form the garment. A method for garment fitting and fabrication includes draping pre-fabricated modular fabric pieces on a wearer.

14 Claims, 25 Drawing Sheets

(56) References Cited

U.S. PATENT DOCUMENTS

| | | | |
|---|---|---|---|
| 6,276,069 | B1 | 8/2001 | Chadwick et al. |
| 6,336,839 | B1 | 1/2002 | Valli |
| 6,751,877 | B2 | 6/2004 | Grove |
| 6,991,611 | B2 | 1/2006 | Rhee |
| 7,058,471 | B2 | 6/2006 | Watanabe |
| 7,164,962 | B2 | 1/2007 | Petterson |
| 7,578,798 | B2 | 8/2009 | Rhee |
| 7,607,966 | B1 | 10/2009 | Fox |
| 7,670,205 | B2 | 3/2010 | Oyama et al. |
| 7,677,953 | B2 | 3/2010 | Oyama et al. |
| 2009/0215359 | A1 | 8/2009 | Chapman et al. |
| 2009/0233522 | A1 | 9/2009 | Schlatmann |
| 2010/0035512 | A1 | 2/2010 | Jimenez et al. |
| 2010/0035513 | A1 | 2/2010 | Jimenez et al. |

FOREIGN PATENT DOCUMENTS

| | | | |
|---|---|---|---|
| EP | 1179301 | A1 | 2/2002 |
| FR | 2558350 | A1 | 7/1985 |
| GB | 139725 | A | 3/1920 |
| GB | 337273 | A | 10/1930 |
| GB | 1468762 | A | 3/1977 |
| GB | 2201579 | A | 9/1988 |
| GB | 2273646 | A | 6/1994 |
| GB | 2355385 | A | 4/2001 |
| GB | 2371207 | A | 7/2002 |
| WO | 9953783 | A1 | 10/1999 |
| WO | 0158292 | A1 | 8/2001 |
| WO | 2004078077 | A1 | 9/2004 |
| WO | 2010001136 | A1 | 1/2010 |

OTHER PUBLICATIONS

Bowles, K., Steele, J.R. and Chaunchaiyakul, R. (2005) Do current sports brassiere designs impede respiratory function? Medicine & Science in Sports and Exercise 1633-1640.

Bridgman, C., Scurr, J., White, J. and Hedger, W. (2008) Three dimensional kinematics of the breast during a two step star jump. Annual Conference of the British Association of Sport and Exercise Sciences 2008, Journal of Sports Sciences 26:1:S34.

Bruniaux, P. and Vasseur, C. (2001) Modeling and identifying the parameters of a fabric drape model. Textile Research Journal 71(4):336-342.

Bye, E., LaBat, K.L. and DeLong, M.R. (2006) Analysis of body measurement systems for apparel. Clothing and Textiles Research Journal 24(2):66-79.

Chen, C., LaBat, K. and Bye, E. (2010) Physical characteristics related to bra fit. Ergonomics 53(4):514-524.

Cho, Y., Komatsu, T., Inui, S., Takatera, M., Shimizu, Y. and Park, H. (2006) Individual pattern making using computerized draping method for clothing. Textile Research Journal 76(8):646-654.

Fan, J., Newton, E., Au, R. and Chan, S.C.F. (2001) Predicting garment drape with a fuzzy-neural network. Textile Research Journal 71(7):605-608.

Heisey, F.L., Brown, P. and Johnson, R.F. (1988) Three-dimensional pattern drafting: a theoretical framework. Clothing and Textiles Research Journal 6(3):1-9.

Heisey, F.L., Brown, P. and Johnson, R.F. (1990) Three-dimensional pattern drafting: Part I: Projection. Clothing and Textiles Research Journal 60:690-695.

Hu, Z., Ding, Y., Zhang, W. and Yan, Q. (2008) An interactive co-evolutionary CAD system for garment pattern design. Computer-Aided Design 40:1094-1104.

Ibrahim, S.M. (1968) Mechanics of form-persuasive garments based on spandex fibers. Textile Research Journal 38:950-963.

Ji, F., Li, R. and Qiu, Y. (2006) Three-dimensional garment simulation based on a mass-spring system. Textile Research Journal 76(1):12-17.

Krenzer, G., Starr, C. and Branson, D. (2005) Development of a sports bra prototype. Patternworks International Best Solution to a Patternmaking Problem, 2000. Clothing and Textiles Research Journal 23(2):131-134.

Lawson, L. and Lorentzen, D. (1990) Selected sports bras: comparisons of comfort and support. Clothing and Textiles Research Journal 8(4):55-60.

Lee, H., Hong, K. and Kim, E.A. (2004) Measurement protocol of women's nude breasts using a 3D scanning technique. Applied Ergonomics 35:353-359.

Liu, Y. and Geng, Z. (2003) Three-dimensional garment computer aided intelligent design. Journal of Industrial Textiles 33(1):43-54.

Loker, S. and Ashdown, S. (2008) Dress in the third dimension: online interactivity and its new horizons. Clothing & Textiles Research Journal 26(2):164-176.

Mason, B.R., Page, K. and Fallon, K. (1999) an analysis of movement and discomfort of the female breast during exercise and the effects of breast support in three cases. Journal of Science and Medicine in Sport 2(2):134-144.

McGhee, D.E. and Steele, J.R. (2006) How do respiratory state and measurement method affect bra size calculation. Br. J. Sports Med. 40:970-974.

McGhee, D.E., Power, B.M. and Steele, J.R. (2007) Does deep water running reduce exercise-induced breast discomfort? Br. J. Sports Med. 41:879-883.

Page, K. and Steele, J.R. (1999) Breast motion and sports brassiere design: implications for future research. Sports Med. 27(4):205-211.

Parsons, J.L. and Campbell, J.R. (2004) Digital apparel design process: placing a new technology into a framework for the creative design process. Clothing and Textiles Research Journal 22(1/2):89-99.

Scurr, J., White, J. and Hedger, W. (2009) Breast displacement in three dimensions during the walking and running gait cycles. Journal of Applied Biomechanics 25:322-329.

Shin, K. (2007) Patternmaking for the underwired bra: new directions. JTI 98(4):301-317.

Wang, J., Lu, G., Li, W., Chen, L. and Sakaguti, Y. (2009) Interactive 3D garment design with constrained contour curves and style curves. Computer-Aided Design 41:614-625.

White, J.L., Scurr, J.C. and Smith, N.A. (2009) The effect of breast support on kinetics during overground running performance. Ergonomics 52(4):492-498.

Winakor, G., Beck, M.S. and Park, S. (1990) Using geometric models to develop a pattern for the lower bodice. Clothing and Textiles Research Journal 8(2):49-55.

Wood, K., Cameron, M. and Fitzgerald, K. (2008) Breast size, bra fit and thoracic pain in young women: a correlational study. Chiropractic & Osteopathy 16:1-7.

Zheng, R., Yu, W. and Fan, J. (2007) Development of a new Chinese bra sizing system based on breast anthropometric measurements. International Journal of Industrial Ergonomics 37:697-705.

Zhong, Y. (2009) Fast penetration resolving for multi-layered virtual garment dressing. Textile Research Journal 79 (9):815-821.

Zhong, Y. and Xu, B. (2009) Three-dimensional garment dressing simulation. Textile Research Journal 79(9):792-803.

* cited by examiner

--- Fold lines

SYSTEM AND METHOD FOR GARMENT FITTING AND FABRICATION

FIELD OF THE INVENTION

The invention relates to a system and method for garment fitting and fabrication.

BACKGROUND OF THE INVENTION

Foundation garments and swimwear require close accommodation to the body. Foundation garments are undergarments designed to temporarily alter the wearer's body shape by supporting, stabilizing or contouring body parts to enhance the figure or to alleviate medical problems. Typical foundation garments include for example, brassieres, girdles, corsets, corselets, bodysuits, body briefers, control underwear, and control panel nylons.

The female breast is a modified subcutaneous gland located on the anterior chest wall within the superficial fascia, with the deep layer of the fascia marking the breast's posterior boundary and the superficial portion of the fascia marking the anterior boundary. The breast is composed of the skin, subcutaneous tissue, and the corpus mammae (i.e., ducts, lobules, areolar structures, connective tissue, lymphatics, fat, blood vessels and nerves). Breast support is dependent upon the skin and weak suspensory ligaments (Cooper's ligaments) which are attached to the deep fascia overlying the pectoralis muscles. Due to limited intrinsic support, the breast is easily displaced during activity and may cause breast pain, particularly during exercise (Scurr et al., 2009; White et al., 2009; Bridgman et al., 2008; McGhee et al., 2007; Mason et al., 1999). Without proper support, the ligaments and skin may stretch, leading to breast sag or ptosis. Repeated loading leads to ligament creep and permanent stretching of the supporting structures of the breast. As gravity pulls down the breasts, the throat and face tissue are also pulled downwardly.

Research on breast biomechanics indicates that proper breast support may be an effective form of treatment for breast pain, prevention of ptosis, and avoidance of breast reductions in women having macromastia. Bras provide support and contour to the breasts; however, poorly fitted bras may cause discomfort, mastalgia, muscle tension, neck and back pain, headaches, fatigue, upper limb neural symptoms, abrasions, furrows caused by bra straps, poor posture, impaired circulation, shoulder strain, and breathing problems (Chen et al., 2010; McGhee et al., 2006; Bowles et al., 2005). It has been estimated that 70% of women wear incorrectly sized or poorly fitted bras (Wood et al., 2008).

Attempts have been made to improve the structure of bras to enhance breast support, as disclosed in U.S. Pat. No. 2,406,699 to Lustig; U.S. Pat. No. 5,215,494 to Flanagan; U.S. Pat. No. 5,603,653 to Hartman; U.S. Pat. No. 5,908,346 to McCall; U.S. Pat. No. 7,607,966 to Fox; EP Patent Application No. 1,179,301 to Yoshihara; GB Patent Specification No. 139,725 to Barbu; and International Publication No. WO 2010/001136 to Morgan and Powell Vreeswiijk.

Girdles are commonly worn to support or mold the waist, stomach, hips, buttocks and thighs, to improve posture, and to provide pregnant women with back support. Girdles are commonly formed of materials having elasticity or stretch (Ibrahim, 1968). However, proper fitting of a girdle tends to be difficult since a girdle spans rounded areas of the body such as the stomach, hips and buttocks. Overly large girdles may fail to provide the required support, gape or bulge at the seams, or ride up and down the body, creating unflattering wrinkles under clothing. Girdles which are too small may constrict the body, impede breathing or circulation, dig into the flesh, and cause excess skin or fat to roll over the edges of the girdle. As with bras, women tend to select the wrong girdle size or have difficulty finding a properly fitting girdle which permits sitting, moving, and breathing without discomfort.

Improved girdles or lower body garments are disclosed for example, in U.S. Pat. No. 2,863,152 to Blatt; U.S. Pat. Nos. 2,775,767 and 3,261,359 to Gould; U.S. Pat. No. 3,339,554 to Nobbs; U.S. Pat. Nos. 6,991,611 and 7,578,798 to Rhee; GB Patent Application No. 2,273,646 to Kumai et al.; and International Publication No. WO 99/53783 to Balit.

Numerous methods have been developed to measure the human body to improve garment fit including, for example, linear methods including a tape measure, direct measure, proportional measure, anthropometer, calipers; multiple probe methods including complex anthropometer, somatography, minott method, planar method, CLAM, photography; body form methods including draping, casting, and body scans using lasers, millimeter waves, and structured light; and systems using data collection, data analysis, and/or data output, as disclosed by Loker and Ashdown, 2008; Bye et al., 2006; and Lee et al., 2004; and in U.S. Pat. No. 6,101,424 to Sawada; U.S. Pat. No. 7,164,962 to Petterson; US Patent Application Publication No. 2009/0215359 to Chapman et al.

Various types of garments or devices have been developed to obtain body measurements when fitted onto the body, as disclosed in U.S. Pat. Nos. 2,180,180 and 2,283,108 to Versoy; U.S. Pat. No. 337,273 to Grinager and Ongley; U.S. Pat. No. 2,858,832 to Loeffel et al.; U.S. Pat. No. 4,868,990 to Steinberg; U.S. Pat. No. 6,276,069 to Chadwick et al.; U.S. Pat. No. 6,751,877 to Grove; GB Patent Specification No. 1,468,762 and GB Patent Application No. 2,201,579 to Sutherland; GB Patent Application No. 2,355,385 and GB Patent No. 2,371,207 to Nabarro.

Methods using a series of "try-on" apparels of predetermined dimensions are disclosed in U.S. Pat. Nos. 5,548,519 and 5,768,135 to Park et al.; U.S. Pat. No. 6,336,839 to Valli; and U.S. Pat. No. 7,058,471 to Watanabe.

Several ISO standards relate to size designation of clothes including foundation garments (ISO 3635, ISO 4416, and ISO/TR 10652). These standard sizes describe combinations of body measurements that are commonly seen in the general population. Many women do not fall within these standard sizes if they have irregular proportions or belong to a demographic profile where women are generally smaller (for example, Asia; Zheng et al., 2007). As women age, their anatomical or physiological changes affect clothing fit (Ashdown and Na, 2008). Since there are many variations in women's figures and proportions, providing satisfactory fit with foundation garments such as bras and girdles and swimwear remains challenging for manufacturers and retailers.

Most foundation garments and swimwear are designed for the mass market in large quantities and standard sizes. At the onset, designers provide sketches of garments to pattern makers to create rough sample garments. Patterns can be formed by 2-D processes including flat, drafting and reverse engineering methods (Shin, 2007). In the flat method, a pattern is generated from an existing foundation pattern known as a block from which garment styles can be created. The pattern maker creates a new style by adding design details. In the drafting method, patterns are drawn directly onto paper using collected measurements taken from a pre-existing garment, an individual or a body form. In the reverse engineering process, patterns are made from an existing garment which is taken apart to generate pattern pieces.

Patterns can also be formed by 3-D processes including draping, wherein a garment is produced by applying inexpensive fabric such as muslin directly onto a 3-D form. The muslin is adjusted while on the 3-D form and details of the drape are marked (e.g., any darts, seams, gathers, tucks to remove or control buckling fabric). The drape is transferred to pattern paper to be traced. The 2-D pattern pieces are used to generate the sample garment. However, this method has its disadvantages since the body form may not necessarily represent real body proportions, and muslin may not share the characteristics of the specific fabric that will be used to make the final garment. Further, errors are introduced as garment details are translated from 3-D to 2-D and back to 3-D (Heisey et al., 1988). The method also does not consider personal preferences for loose or tight fitting clothing. The fit of the sample garments is confirmed by using mannequins or models. Several iterations of sample garments are required before the final garment is approved for mass manufacture. Following alterations and approval of the final stock fit, the factories begin production.

Custom-made foundation garments and swimwear are made according to the specifications of the wearer, but their creation is often expensive and time-consuming, requiring the wearer to make multiple appointments for detailed measuring, fitting and alterations.

There is thus a need in the art for methods for facilitating the fitting and preparation of foundation garments and swimwear.

SUMMARY OF THE INVENTION

The present invention relates to a system and method for garment fitting and fabrication.

In one aspect, the invention comprises a system for manufacturing a garment for a wearer comprising a fabric template and a plurality of fabric pieces attachable to the template to form the garment.

In one embodiment, the fabric template comprises a plurality of bands which are interconnected and arranged to form a foundation, a lower lift section, and an upper lift section.

In one embodiment, the foundation comprises a bandeau. In one embodiment, the bandeau section comprises a breast-covering part, upper and lower edges, ends, and adjustable fastening means. In one embodiment, the bandeau is formed of an elasticized or resilient form-fitting material.

In one embodiment, the foundation further comprises a suspender section, a girdle section, and a corset section.

In one embodiment, the suspender section comprises bands connecting the bandeau to the girdle section in a criss-cross pattern overlying the wearer's back.

In one embodiment, the girdle section comprises bands traversing in a criss-cross pattern overlying the wearer's front pelvic region, and extending underneath the wearer's buttocks and upwardly from between the wearer's thighs to converge with the suspender section, and bands at the top of the criss-cross pattern converging at the back of the wearer's waist.

In one embodiment, the corset section comprises a lower edge of the bandeau, the suspender section, and bands of the girdle section which criss-cross over the front pelvic region and converge at the back of the wearer's waist.

In one embodiment, the lower lift section comprises bands traversing in a criss-cross pattern overlying the wearer's upper back, and extending downwardly over the wearer's shoulders along the sides of the wearer's breasts to align substantially horizontally below the wearer's breasts.

In one embodiment, the upper lift section comprises bands encircling the wearer's arms and traversing in a criss-cross pattern over the wearer's sternum to isolate each of the wearer's breasts, and to extend over lower portions of the wearer's breasts.

In one embodiment, the garment is a brassiere, a top, a swimsuit, sportswear, a supporting garment, a body-shaping garment, or a medical garment.

In another aspect, the invention comprises a method for preparing a garment for a wearer comprising the steps of:

a) pre-fabricating a plurality of fabric pieces in a variety of sizes, styles, and fabrics, each of the fabric pieces being structured to correspond to respective portions of the above fabric template;

b) draping fabric pieces selected according to the wearer's body contour and preferences on the wearer; and c) completing assembly of the garment.

In one embodiment, before step (b), a bandeau conforming substantially to the torso of the wearer is fitted. In one embodiment, after step (b), the fabric pieces are adjusted to fit the wearer. In one embodiment, the method further comprises pinning the fabric pieces together. In one embodiment, the garment is a brassiere, a top, a swimsuit, sportswear, a supporting garment, a body-shaping garment, or a medical garment. In one embodiment, the garment is prepared within about four hours.

In another aspect, the invention comprises a method for treating or preventing disorders associated with insufficient breast support comprising clothing a subject in a garment manufactured using the above system.

In one embodiment, the disorders are selected from ptosis, mastalgia, macromastia, maceration, intertrigo, muscle tension, neck pain, back pain, headaches, fatigue, upper limb neural symptoms, abrasions, poor posture, impaired circulation, shoulder strain, or breathing problems.

In yet another aspect, the invention comprises a kit for preparing a garment for a wearer comprising a plurality of pre-fabricated fabric pieces in a variety of sizes, styles, and fabrics, each of the fabric pieces being structured to correspond to respective portions of the above fabric template, and instructions for using the fabric pieces to prepare the garment.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings:

FIG. 7A shows half of the bandeau. FIG. 7B shows the same bandeau with addition of fabric pieces to the lower lift section. FIG. 7C shows the bandeau with addition of fabric pieces to the upper lift section. FIG. 7D shows the bandeau with addition of fabric pieces to the lower lift and upper lift sections spanning the wearer's upper back.

DETAILED DESCRIPTION OF PREFERRED EMBODIMENTS

The present invention relates to a system and method for garment fitting and fabrication.

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

The present invention relates to a system and method for garment fitting and fabrication.

In one embodiment, the invention comprises a system for manufacturing a garment for a wearer comprising a fabric template and a plurality of fabric pieces attachable to the template to form the garment. As used herein, the term "wearer" means a female or male adult or child.

Figures 1A, 1B, 1C:
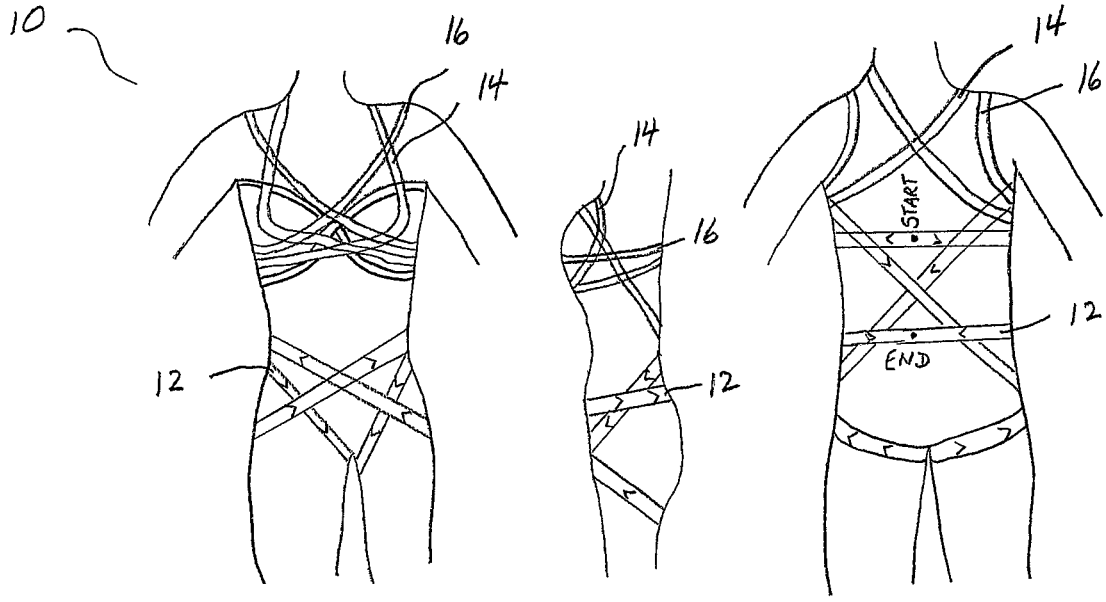
FIGS. 1A-C show front, side and rear views respectively, of a fabric template of the present invention.

FIGS. 1A-C generally show one embodiment of a fabric template (10) of the present invention. The fabric template (10) comprises, a plurality of bands which are interconnected and arranged to form a foundation (12), a lower lift section (14), and an upper lift section (16).

In one embodiment, the foundation (12) comprises a bandeau (18). As used herein, the term "bandeau" means a band-shaped covering for the breasts. The bandeau (18) is a strapless top having sufficient circumference and width to circumnavigate the wearer's torso and to cover the breasts, respectively. The bandeau (18) comprises a breast-covering part (20), upper and lower edges (22, 24), ends (26*a*, 26*b*), and adjustable fastening means (28*a*, 28*b*, 28*c*). The breast-covering part (20) has a criss-cross shape to enable centering of the bandeau (18) on the sternum of the wearer's body.

The bandeau (18) is formed of an elasticized or resilient form-fitting material to encircle the wearer's torso snugly, yet comfortably, and to impart sufficient compression to stabilize and shape the breasts. Suitable materials include, but are not limited to, nylon, spandex, darlex, Lycra™, jersey, cotton, polyurethane, neoprene, elastomer and the like. The material may be a breathable fabric. The bandeau (18) may be in the form of a circular knit-type sock made in different circumferences and which can be adjusted to the depth of the breasts when placed on the body. A material which is shaped by heat or pressure, and retains its shape upon removal from the body may also be used.

The upper edge (22) of the bandeau (18) rests over the top of the breasts against the chest to compress the breasts downward to limit any upward movement of the breasts. In one embodiment, the upper edge (22) of the bandeau (18) extends under the arm and across the back in a horizontal line to connect with itself at the center back. This configuration applies to garments requiring only upper body support such as, for example, brassieres or tops. In one embodiment, the upper edge (22) of the bandeau (18) extends to form the suspender section (30) as described below. This configuration applies to garments requiring both upper and lower body support such as, for example, foundation garments.

The lower edge (24) of the bandeau (18) is positioned at the inframammary fold to support the breasts in a raised position. It will be recognized by those skilled in the art that the underbust band of a bra generally sits at the inframammary fold and holds the breast in a pert position with the breast lifted away from the chest wall; however, after hours of wear, the band crushes or rolls over or under the ptosis. To prevent this problem, the lower edge (24) preferably supports the breast in a pseudo-ptosis state at about 1 to 2 cm above the inframammary fold. The lower edge (24) traverses the wearer's back horizontally.

Figure 2A:
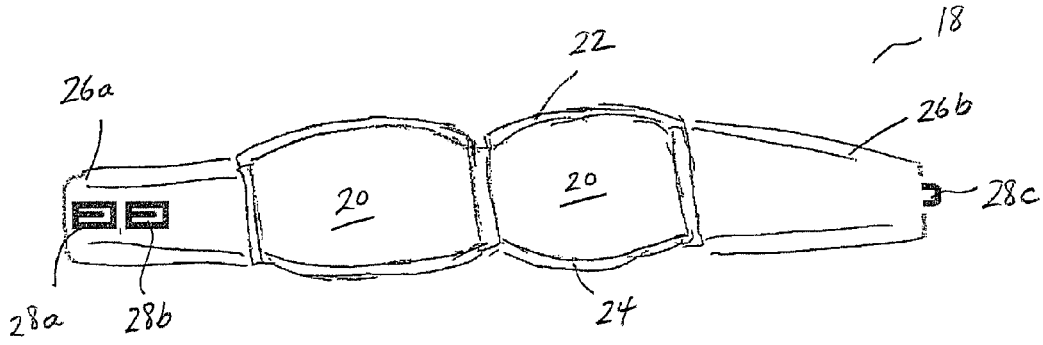
FIG. 2A shows a front view of a bandeau of the present invention.

The ends (26*a*, 26*b*) of the bandeau (18) may meet at either the wearer's front or back, or both. FIG. 2A shows one embodiment of the bandeau (18) in which the ends (26*a*, 26*b*) meet at the wearer's back. As will be appreciated by those skilled in the art, physical dexterity is required to put on or remove a bra. A back closure requires the wearer to contort both arms and hands to the mid-back section, or to remove the bra straps and rotate the closure to the front. If the wearer is physically incapacitated for example, by a dislocated shoulder, rotator cuff disability, and the like, a front closure may be preferred. The ends (26*a*, 26*b*) of the bandeau (18) include fastening means (28*a*, 28*b*, 28*c*) for securing one end to the other, preferably in adjustable fashion. The fastening means (28*a*, 28*b*, 28*c*) may be any fastening means known in the art such as hooks and eyes, snaps, studs, pop fasteners, snap tape, or Velcro™

Figures 2B, 2C, 2D:
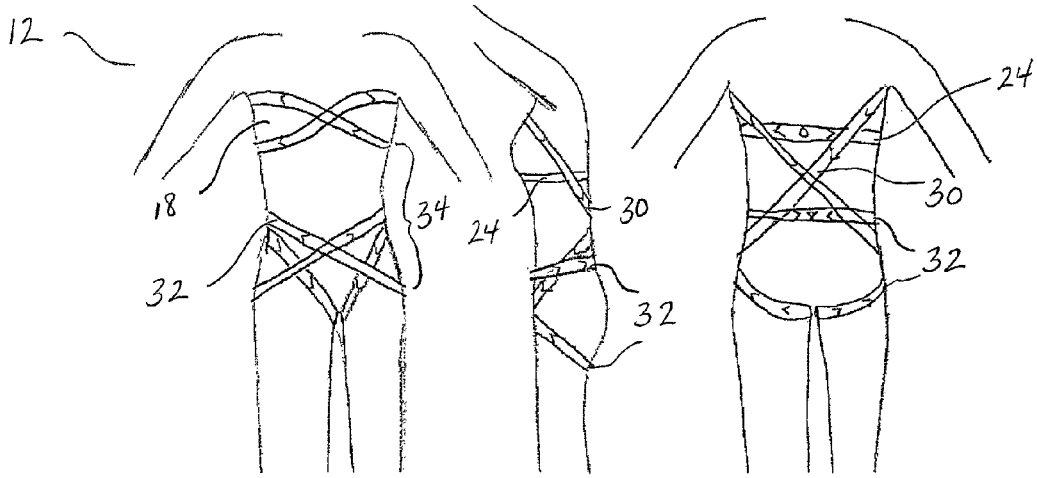
FIGS. 2B-D show front, side and rear views respectively, of a foundation of the present invention.

In one embodiment, the foundation (12) comprises in addition to the bandeau (18), a suspender section (30), a girdle section (32), and a corset section (34). The suspender section (30) serves as "a suspension bridge" between the wearer's thorax and pelvis. The suspender section (30) comprises bands connecting the bandeau (18) to the girdle section (32) in a criss-cross pattern overlying the wearer's back. As shown in FIGS. 2C-D, the upper edge (22) of the bandeau (18) extends on both sides of the wearer's body under the arms to the back in a downward diagonal direction to form a criss-cross under the lower edge (24) of the bandeau (18). The upper edge (22) intersects with the lower edge (24) of the bandeau (18). This configuration (or use of the hips) counterbalances the weight of the breasts which would otherwise cause the lower edge (24) of the bandeau (18) to rise. The upper back is supported from the weight and strain of the breasts since the load on the upper back is reduced by transferring the weight and strain to the hips. Further, the intersection of the upper edge (22) with the lower edge (24) of the bandeau (18) creates an underarm triangle or "wing" which supports and stabilizes the breasts towards the center frontline, restricting the pendulous trajectory. Through its attachment to the girdle section (32), the suspender section (30) prevents the girdle section (32) from slipping downwards.

The girdle section (32) supports and holds in the wearer's lower abdominal wall. The girdle section (32) comprises bands which traverse in a criss-cross pattern overlying the wearer's front pelvic region. The bands then extend underneath the wearer's buttocks and upwardly from between the wearer's thighs to converge with the suspender section (30). As used herein, the term "converge" means to merge or to join at a shared point. At the top of the criss-cross pattern, the bands converging at the back of the wearer's waist. As shown in FIGS. 2B-D and with reference to specific human anatomy, the bands for the girdle section (32) traverse from opposite iliac crests to form a criss-cross pattern at the lower abdominal wall. The bands then wrap over the ilium from front to back to converge with the suspender section (30). At the top of the criss-cross pattern, the bands converge at the sylliac on the back of the pelvis. The portion of the bands under the buttocks provides the structure and framework for fabric pieces to support, lift and shape the buttocks.

The corset section (34) supports and holds in the wearer's body from below the chest to the hips. As shown in FIGS. 2B-D, the corset section (34) comprises the lower edge (24) of the bandeau (18), the suspender section (30), and the bands of the girdle section (32) which criss-cross over the front pelvic region and connect at the back of the wearer's waist.

Figure 2E:
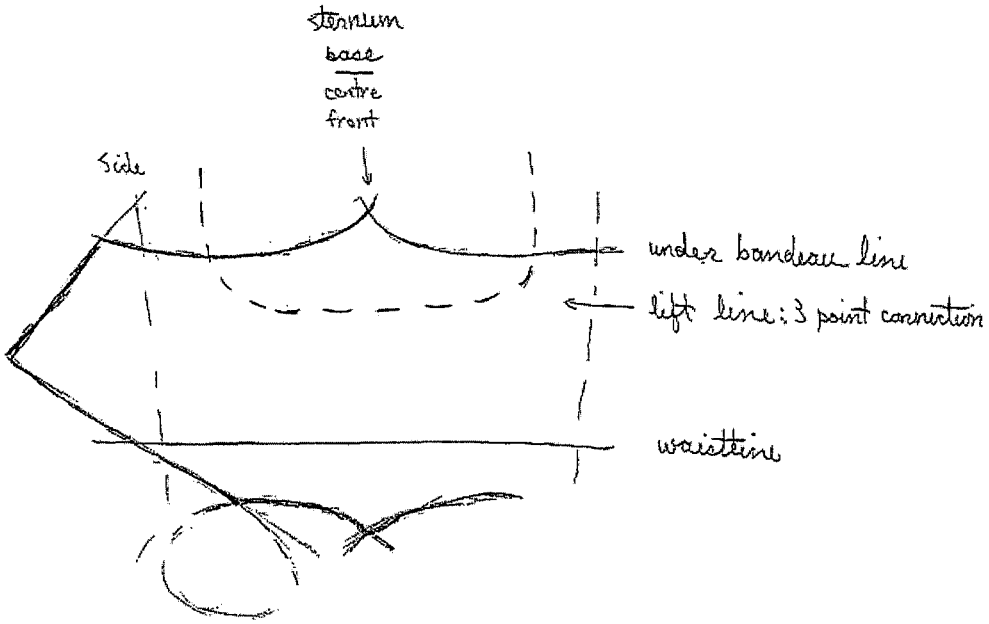
FIG. 2E shows the location of the lift line.

Folds of the skin (for example, the armpits, under the breasts, belly, buttocks, groin, and the area between the fingers or toes) may be prone to intertrigo which can be worsened by any conditions causing increased heat, wetness, and friction, and may be complicated by superficial skin infection with yeast or bacteria. The corset section (34) creates a chest wall ptosis barrier which pockets the breasts, minimizes bounce so as to prevent mastalgia, and wicks moisture to treat or prevent maceration and intertrigo. The chest wall ptosis barrier forms the inner barrier between the chest wall and the ptosis portion of the breast to which the lower lift and upper lift sections (14, 16) attach, creating a pocket within the cradle of the lift to hold the pendulous portion of the breast at an appropriate location for the breast to move outwardly from the chest wall. The location depends on the weight and circumference of the breast mass. In women having macromastia, the location would be at the fourth or fifth rib. This three point connection is designated as "the lift line" (FIG. 2E). As the breast volume increases, the lower lift line sits further down the ribcage. There is also a greater distance vertically between the lower edge (24) of the bandeau (18) at the inframammary fold and the lower lift line. To minimize bounce (hence prevent or treat mastalgia), a band wraps horizontally across the circumference of the thorax from the lift line, crossing past the suspender section (30) and connecting with its opposing end at the center of the spine.

Figures 3A, 3B, 3C:
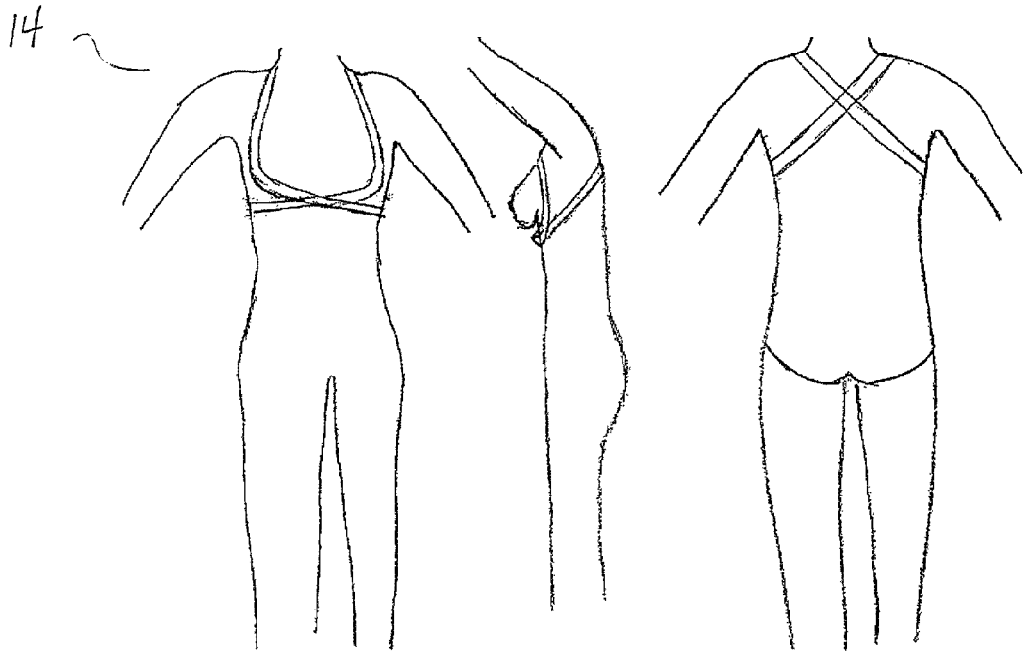
FIGS. 3A-C show front, side and rear views respectively, of a lower lift section of the present invention.

The lower lift section (14) supports the pendulous portion of the breasts. As shown in FIGS. 3A-C, the lower lift section (14) comprises bands which traverse in a criss-cross pattern overlying the wearer's upper back, and extend downwardly over the wearer's shoulders along the sides of the breasts to align substantially horizontally below the pendulous portion of the breasts. The lower lift section (14) pushes the breasts towards the center frontline to restrict pendulous trajectory, and forms a "shelf" for the pendulous portion of the breasts.

Figures 4A, 4B, 4C:
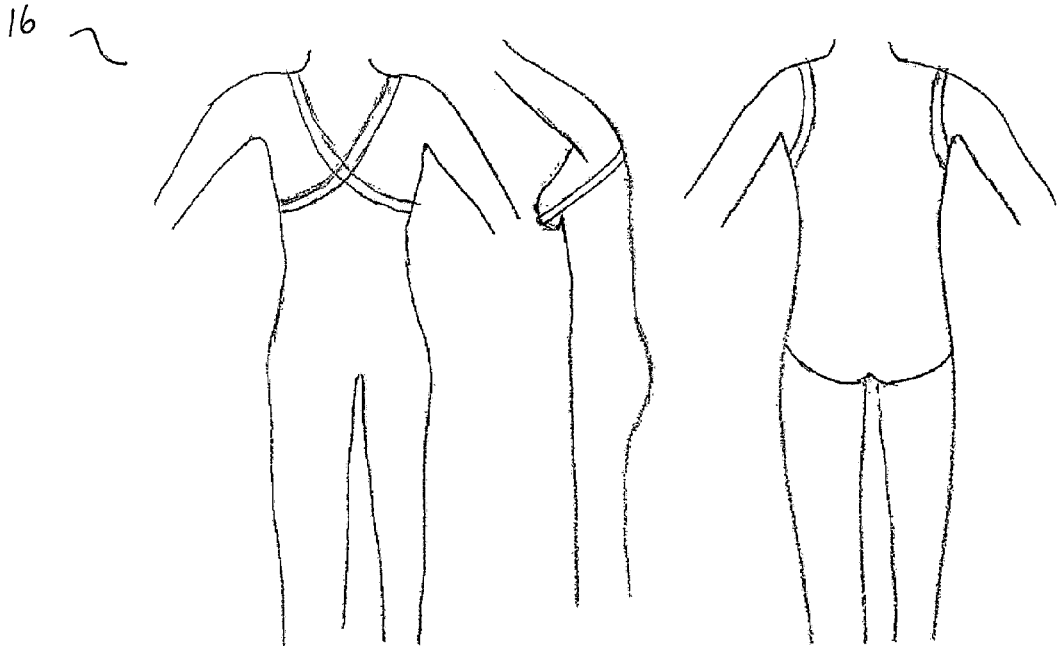
FIGS. 4A-C show front, side and rear views respectively, of an upper lift section of the present invention.

The upper lift section (16) helps to raise the breasts by supporting the lower portions of the breasts. As shown in FIGS. 4A-C, the upper lift section (16) comprises bands which encircle the wearer's arms and traverse in a criss-cross pattern over the wearer's sternum to isolate each of the wearer's breasts, and to extend over the lower portions of the wearer's breasts. The upper lift section (16) provides lift of the breasts towards the chest and separation of the breasts.

The lower lift and upper lift sections (14, 16) together provide secure positioning of the breast to the chest wall to minimize movement during high impact activities such as exercise. A center frontline supporting triangle may be formed by a fabric piece attached at the intersection of the lower lift and upper lift sections (14, 16). A chest supporting triangle may be formed by a fabric piece attached at the intersection of the upper edge (22) of the bandeau (18), and the lower lift and upper lift sections (14, 16).

Figure 5A:
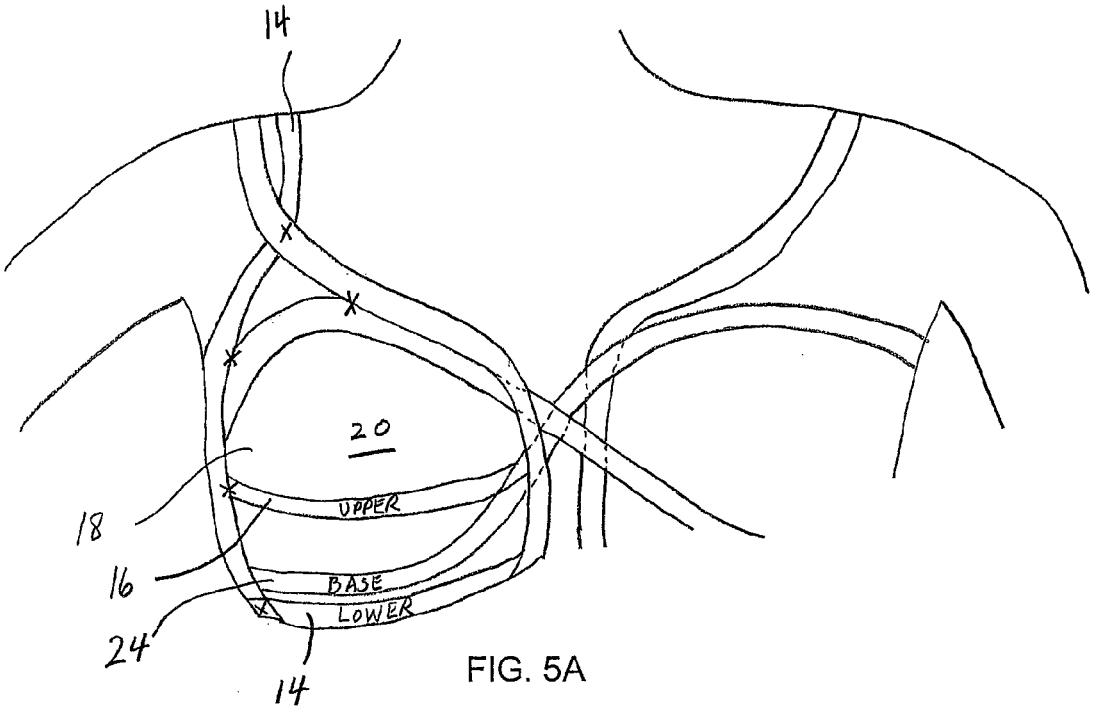
FIGS. 5A-D show connection points among the bands of the foundation, lower lift section, upper lift section, suspender section, girdle section, and corset section.
Figure 5B:
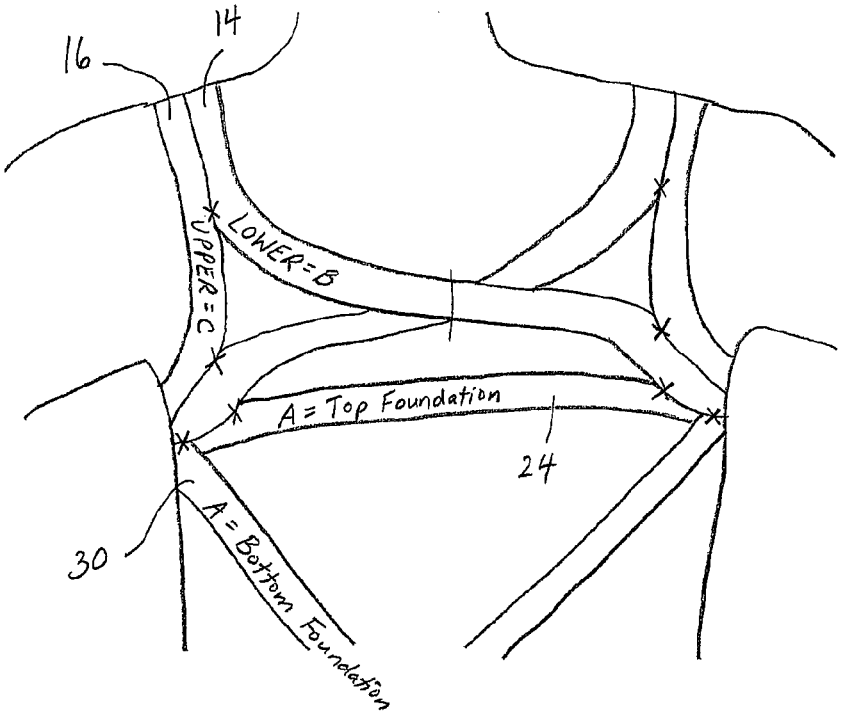
Figure 5C:
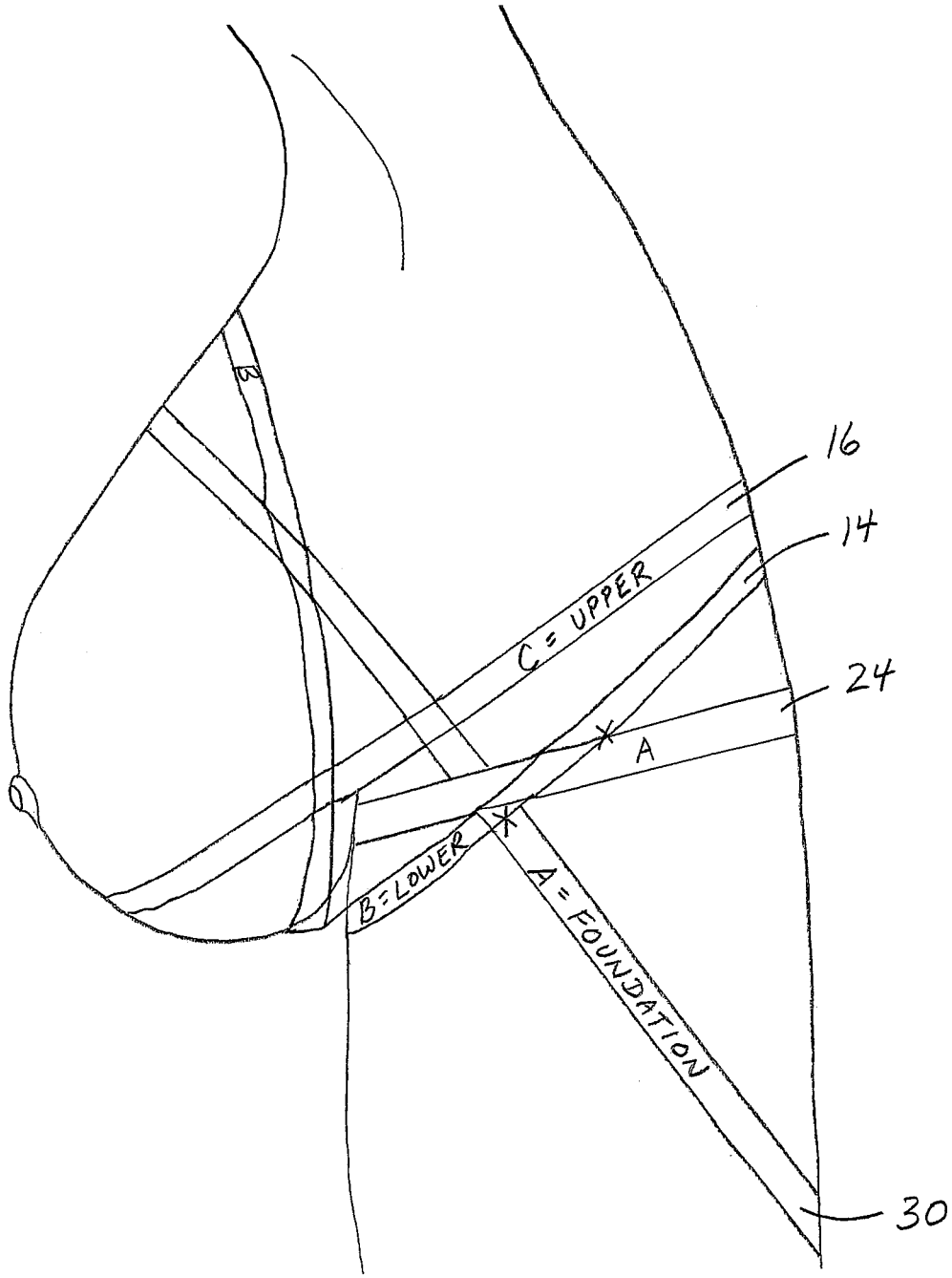
Figure 5D:
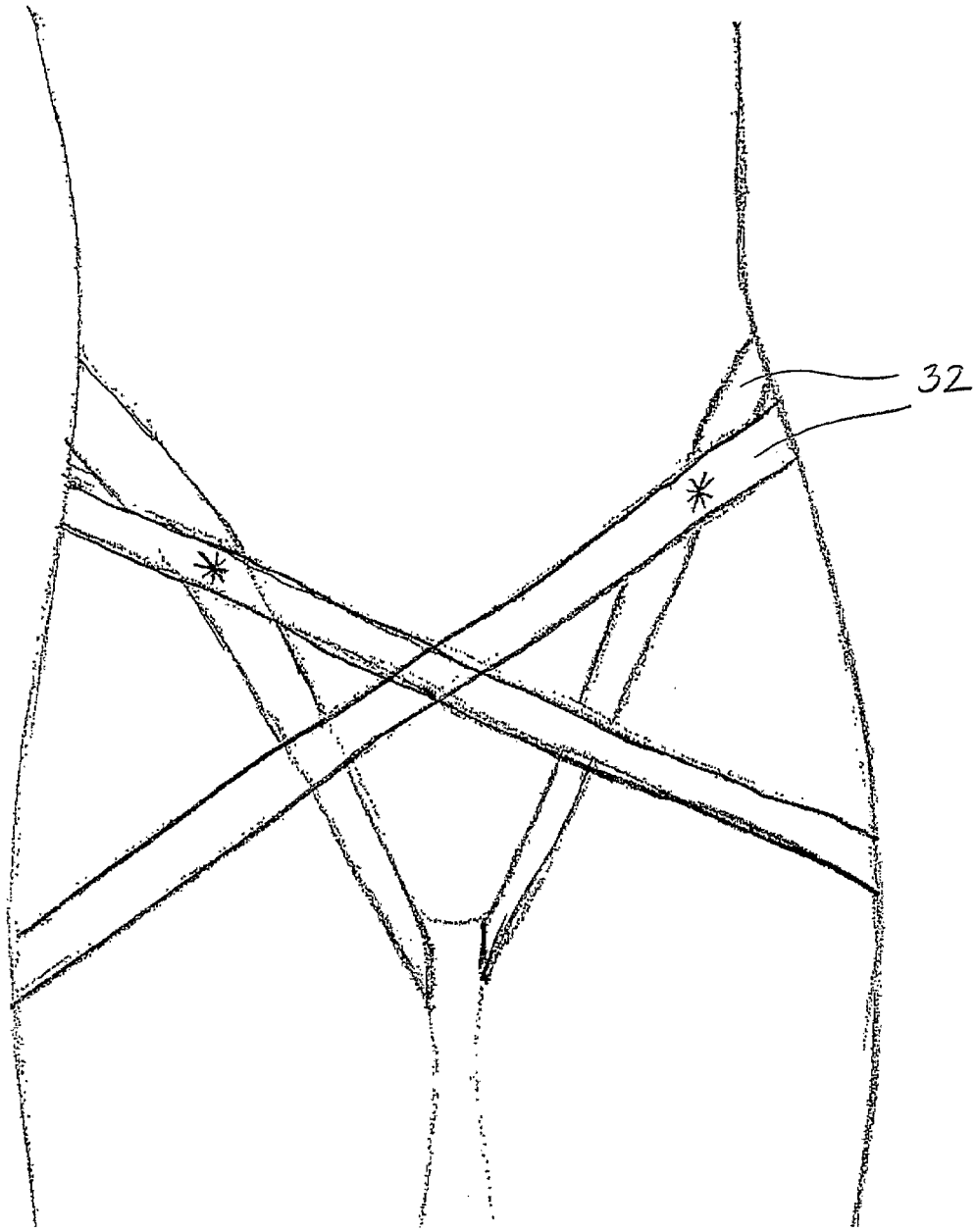

The bands of the foundation (12), lower lift section (14), upper lift section (16), suspender section (30), girdle section (32), and corset section (34) interconnect at various points within the fabric template (10). Connection points are indicated by asterisks in FIGS. 5A-D. FIG. 5A shows a front view of the wearer, indicating connection points among the bandeau (18), the lower lift section (14), and the upper lift section (16). FIG. 5B shows a rear view of the wearer, indicating connection points among the bandeau (18), the lower lift section (14), the upper lift section (16), and the suspender section (30). FIG. 5C shows a side view of the wearer, indicating connection points among the bandeau (18), the lower lift section (14), the upper lift section (16), and the suspender section (30). FIG. 5D shows a front view of the wearer's front pelvic region, indicating connection points within the girdle section (32). The connection points also serve as a guide for the attachment of supporting individual fabric pieces onto the fabric template (10).

The width of the bands for the suspender, girdle and corset sections (30, 32, 34) can be at least two inches or more, although other widths can be used. The bands are formed of a material having sufficient elasticity including, but not limited to, nylon, spandex, darlex, Lycra™, jersey, cotton, polyurethane, neoprene, elastomer and the like.

The fabric template (10) aids garment fitting and fabrication since it indicates the structure and position for individual fabric pieces. The fabric template (10) functions as a frame which defines spaces and shapes for which corresponding fabric pieces are structured. The fabric pieces are selectively attached to provide additional support, to lift and shape the wearer's body, and to yield the desired garment. As used herein, the term "fabric" means any cloth made from yarn or fibres by weaving, knitting, felting, etc. The fabric may be an elastic/stretch fabric including, but not limited to, nylon, spandex, darlex, Lycra™, jersey, cotton, polyurethane, neoprene, elastomer and the like. The fabric may include moisture-absorbing or wicking fibres or yarns capable of wicking or drawing moisture away from the skin. Wicking can be solely due to capillary action, as in the case of polyester or it may be a form of absorbency, as with cotton. Wicking may also be due to hydrophilic properties. The fabric may include fibres or yarns coated with anti-microbial metals selected from Ag, Au, Pt, Pd, Ir, Sn, Cu, Sb, Bi, Zn, and alloys or compounds of one or more of these metals.

Figure 6:
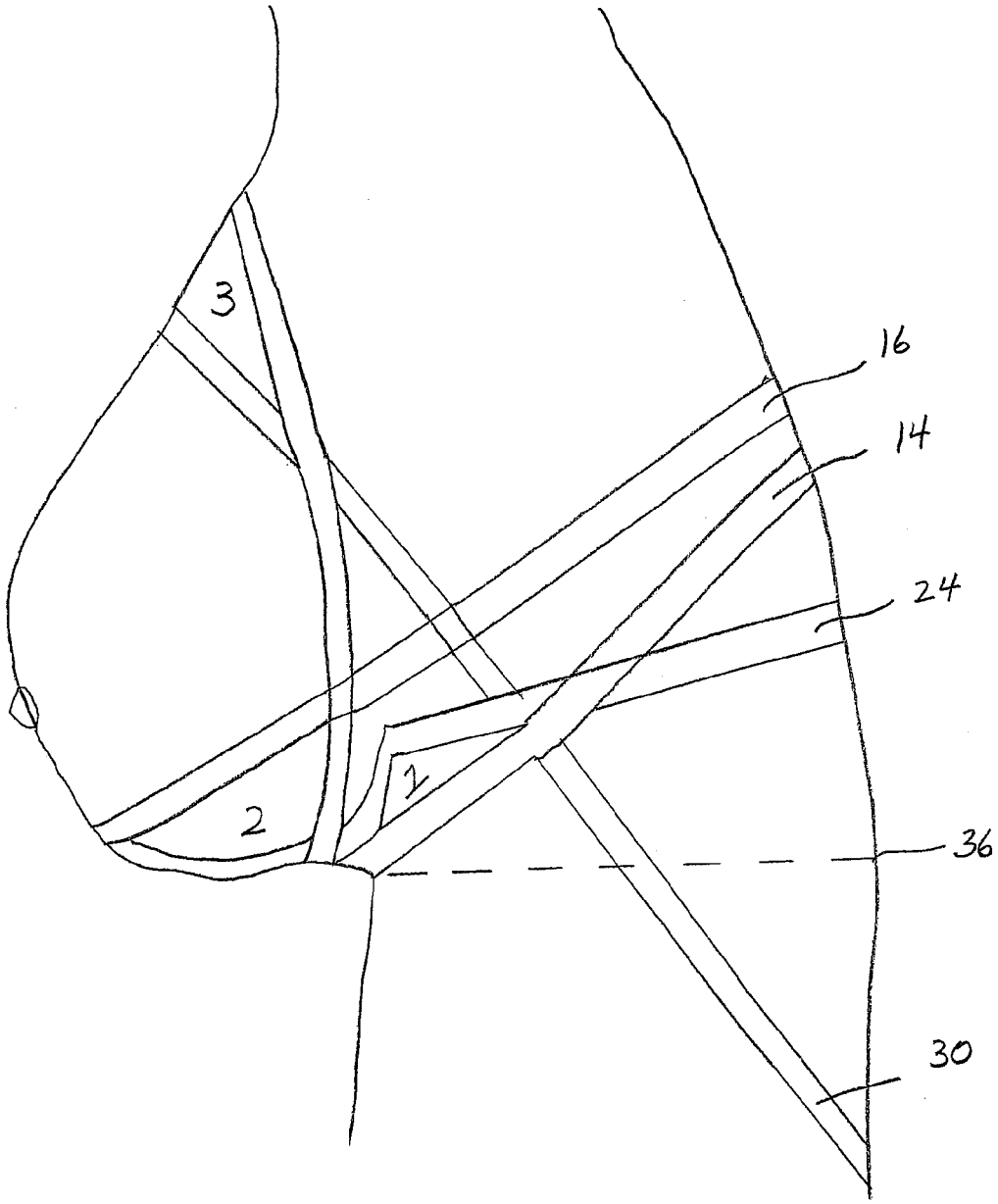
FIG. 6 shows a side view of fabric pieces attached to bands of a fabric template of the present invention.

As shown in FIG. 6, fabric piece "1" is attached to bands of the foundation (12) and upper lift section (16) to lie against the wearer's rib cage. Fabric piece "2" is attached to bands of the upper and lower lift sections (16, 14) to support the breasts in a raised position. Fabric piece "3" is attached to bands of the foundation (12) and lower lift section (14) to minimize any upward movement of the breasts. The end line for the chest ptosis barrier is represented as a dashed line (36).

Figure 7A:
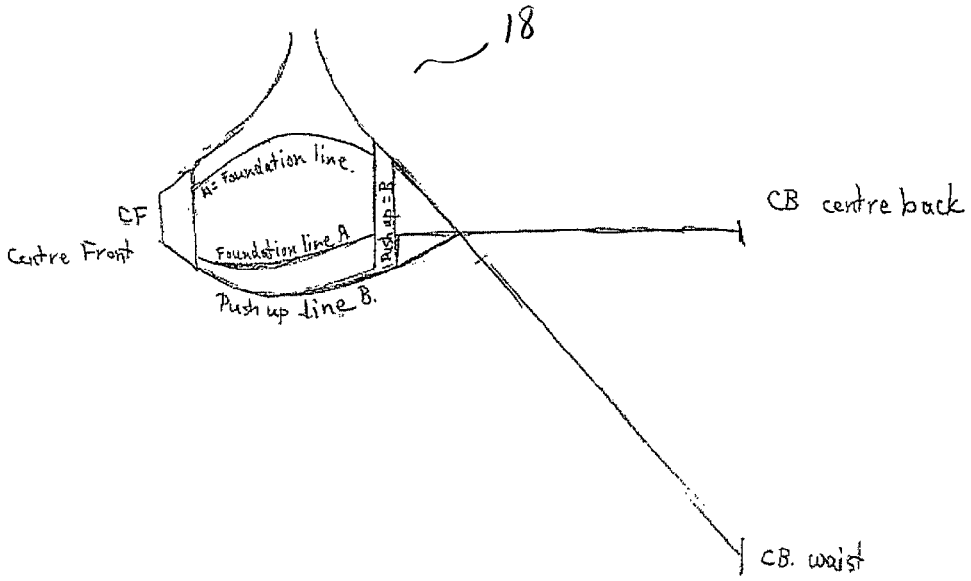
FIGS. 7A-D show views of a full support bra formed using a fabric template of the present invention and fabric pieces.
Figure 7B:
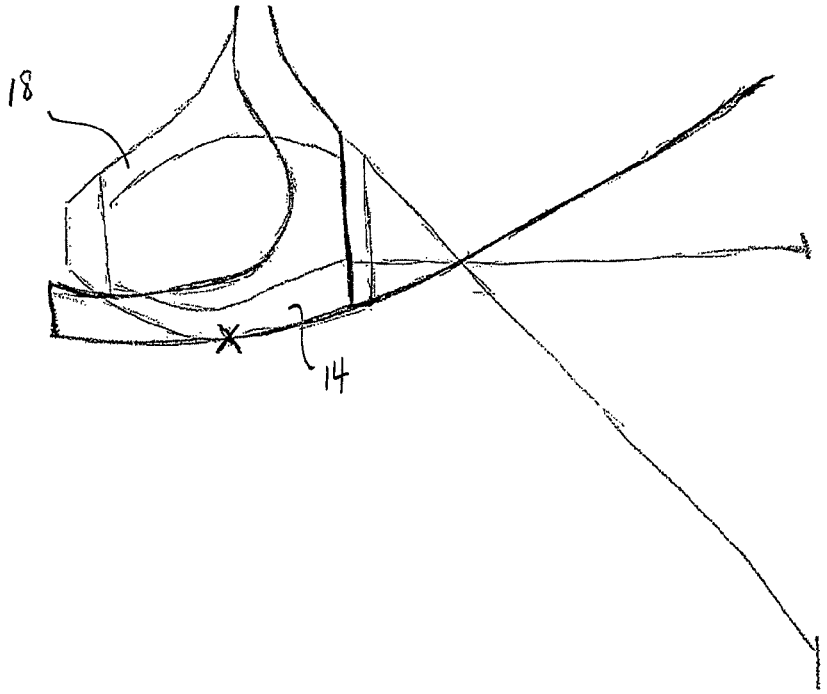
Figure 7C:
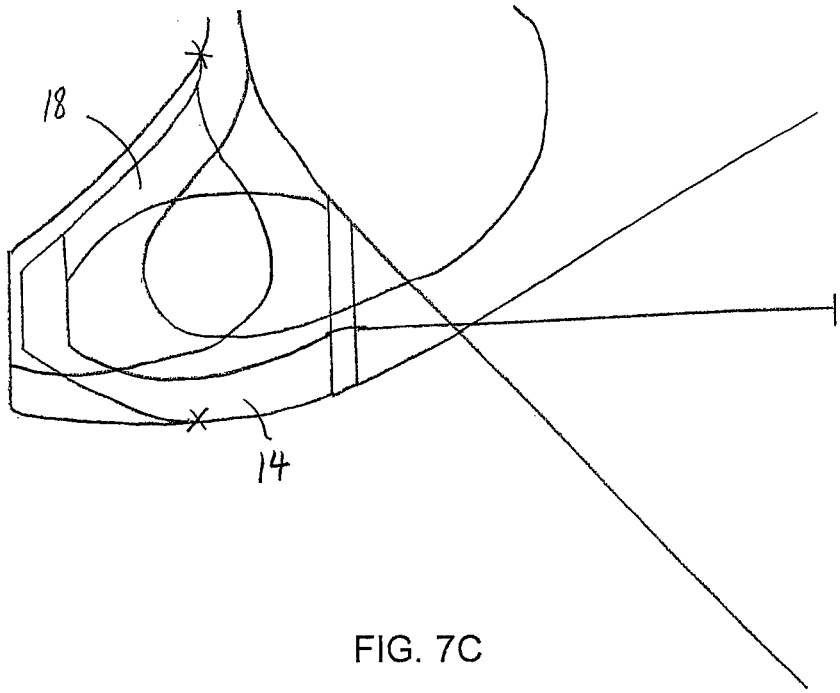
Figure 7D:
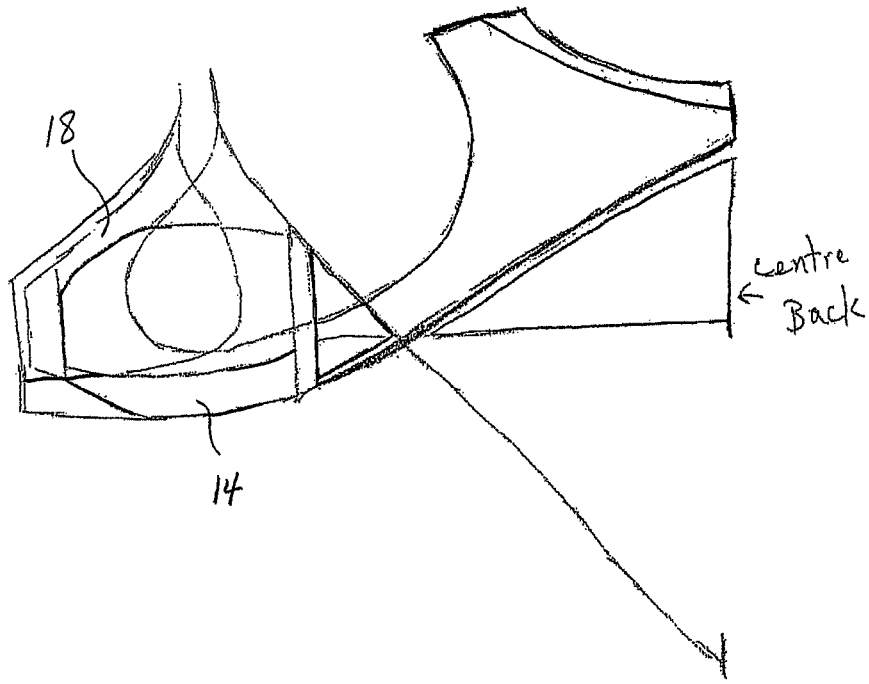

FIGS. 7A-D show a method of execution for forming a full support bra. Fabric pieces are shown superimposed on the bandeau (18) in sequence. FIG. 7A shows half of the bandeau (18). FIG. 7B shows the same half bandeau (18) with addition of fabric pieces to the lower lift section (14). FIG. 7C shows the half bandeau (18) with addition of fabric pieces to the upper lift section (16). FIG. 7D shows the half bandeau (18) with addition of fabric pieces to the lower lift (14) and upper lift (16) sections spanning the wearer's upper back.

It will be understood that many different types of garments can be prepared by attaching fabric pieces to the fabric template (10) of the present invention. As used herein, the term "garment" refers to apparel which covers the upper body region including the breasts, or lower body region including the waist, stomach, hips, buttocks and thighs. In one embodiment, the garment is a brassiere, top, swimsuit, sportswear, or a medical garment. As used herein, the term "brassiere" or "bra" means a structure which conceals, supports and elevates the bust of the wearer. As used herein, the term "top" means garments which cover the upper body or torso, and include a bottom hem at one end, and a neckline at the other end. Examples of tops include camisoles, blouses, halter tops, shirts, tank tops, tube tops, t-shirts, polo shirts, sports jerseys, and golf shirts. As used herein, the term "swimsuit" for women means either a two-piece bra and panty ensemble or a one-piece maillot style. As used herein, the term "sportswear" means active wear garments designed for comfort and casual wear including, for example, swimsuits, wetsuits, leotards, bodysuits, salopettes, cycling suits, and tracksuits. As used herein, the term "medical garment" means a garment designed for postoperative and/or therapeutic use, and includes garments typically used after plastic, aesthetic, reconstructive, orthopaedic, general, surgical, and burn treatment applications. Examples of medical garments include mastectomy brassieres, surgical vests and corsets, abdominal belts or girdles, lymphoedema garments, body suits, trunk bandages, and other postoperative compression garments.

Figure 8A:
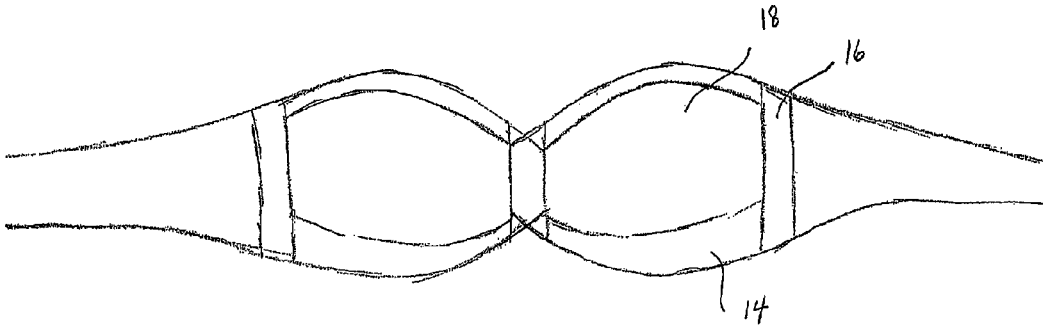
FIGS. 8A-D show front views of various embodiments of bras foamed using a fabric template of the present invention: bandeau bra (FIG. 8A), push-up bra (FIG. 8B), plunging neckline bra (FIG. 8C), and asymmetrical bra (FIG. 8D).
Figure 8B:
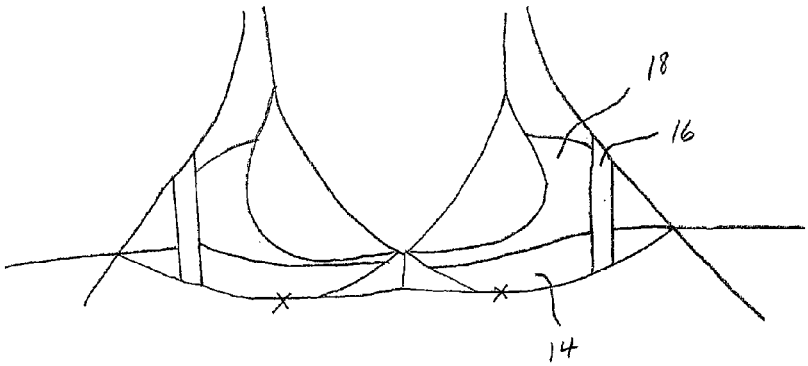
Figure 8C:
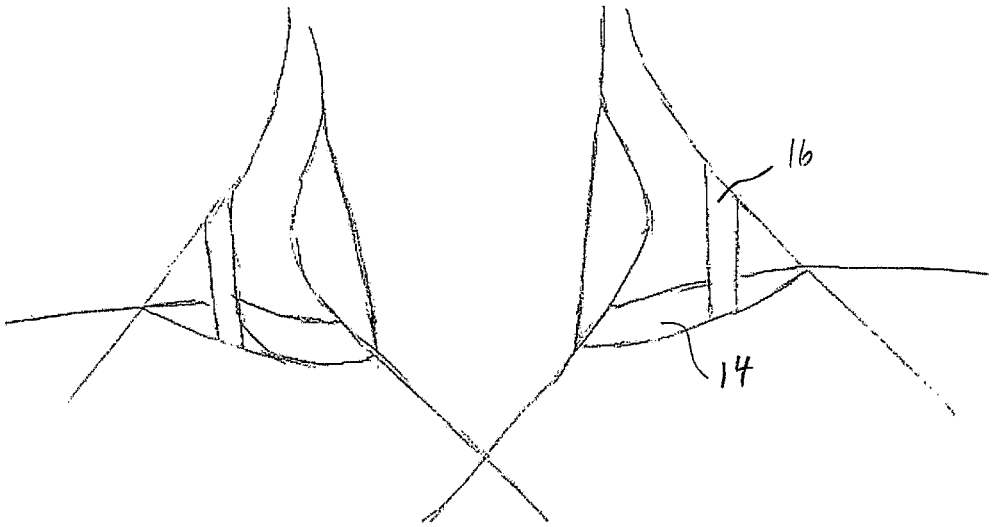
Figure 8D:
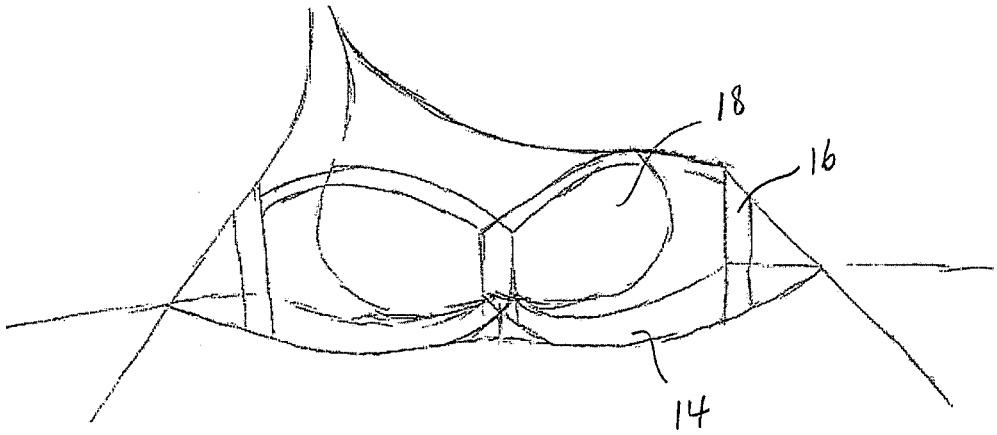
Figure 9A:
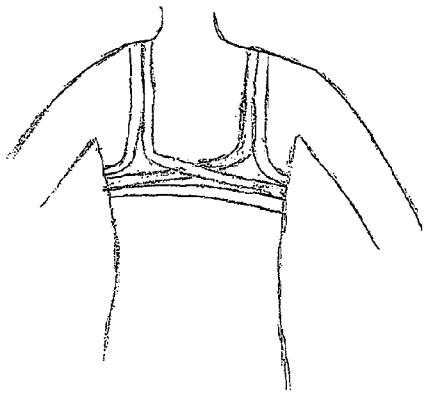
FIGS. 9A-C show rear views of various embodiments of garments formed using a fabric template of the present invention: sports bra (FIG. 9A), cross-back bra (FIG. 9B), and halter top (FIG. 9C).
Figure 9B:
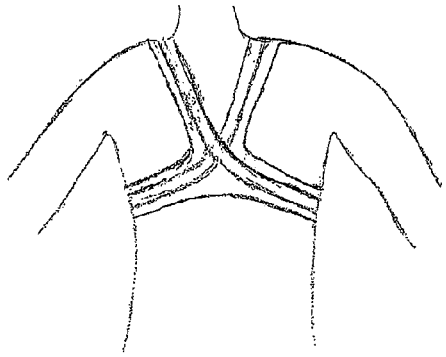
Figure 9C:
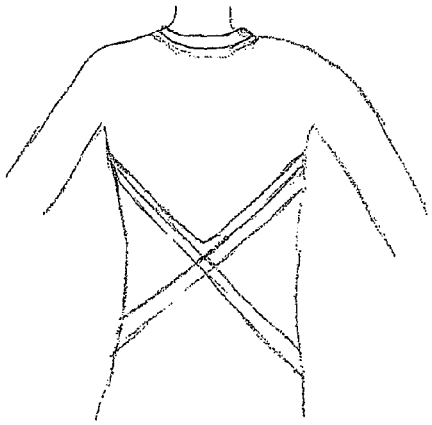
Figure 10A:
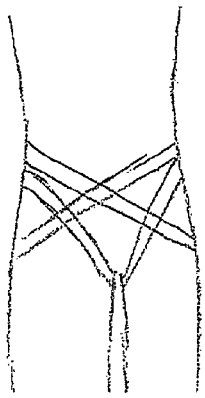
FIGS. 10A-C show front, side and rear views respectively, of a lower body supporting garment formed using a fabric template of the present invention.
Figure 10B:
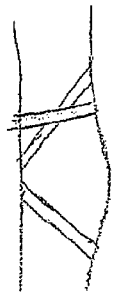
Figure 10C:
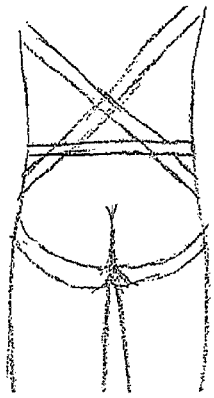
Figure 11A:
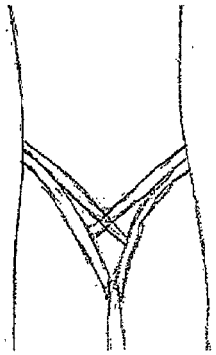
FIGS. 11A-C show front, side and rear views respectively, of a high-waisted, thonged back garment formed using a fabric template of the present invention.
Figure 11B:
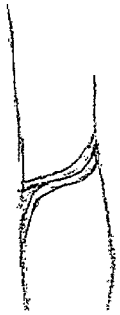
Figure 11C:
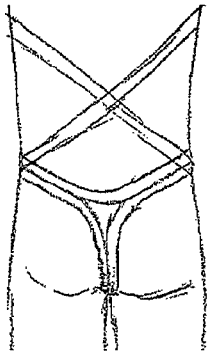
Figure 12A:
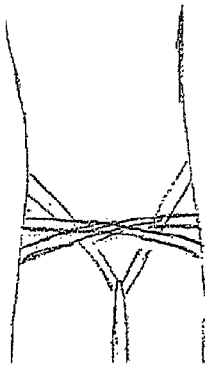
FIGS. 12A-C show front, side and rear views respectively, of a hipster waist, partial back coverage garment formed using a fabric template of the present invention.
Figure 12B:
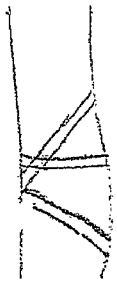
Figure 12C:
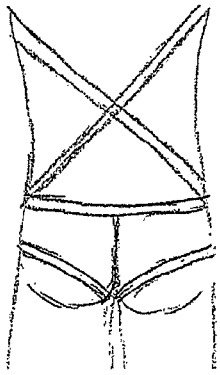
Figure 13A:
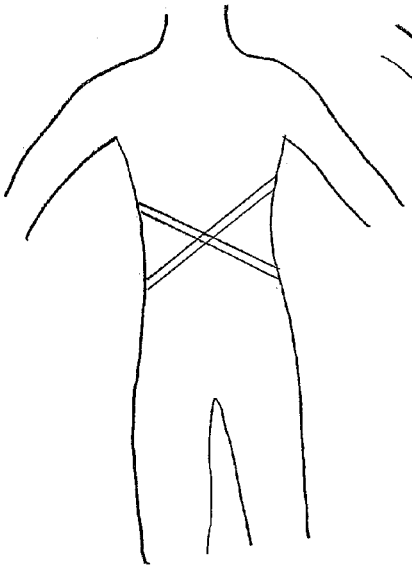
FIGS. 13A-C show front, side and rear views respectively, of an upper torso shaper formed using a fabric template of the present invention.
Figure 13B:
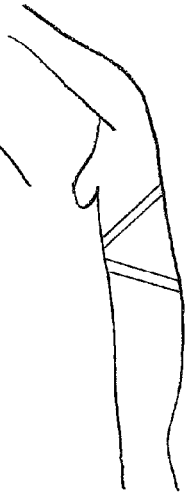
Figure 13C:
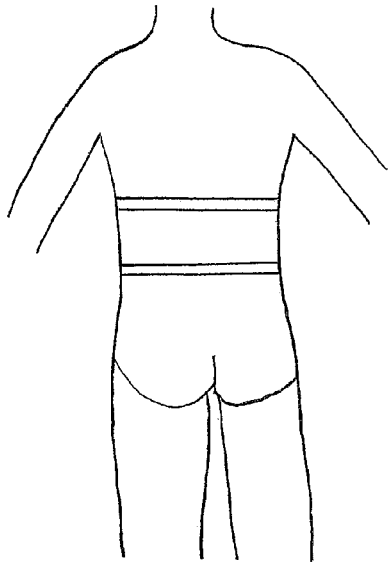
Figure 14:
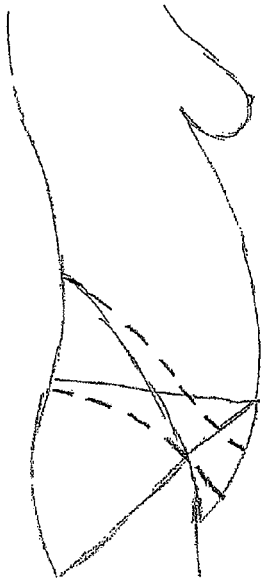
FIG. 14 shows a side view of a maternity shaper or obesity body shaper formed using a fabric template of the present invention.
Figure 15:
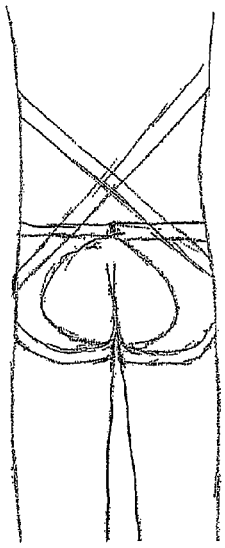
FIG. 15 shows a rear view of a bottomless buttock shaper formed using a fabric template of the present invention.

The following figures show garments which may be fabricated using the system of the present invention including, for example, a bandeau bra (FIG. 8A); push-up bra (FIG. 8B); plunging neckline bra (FIG. 8C); asymmetrical bra (FIG. 8D); sports bra (FIG. 9A); cross-back bra (FIG. 9B); halter top (FIG. 9C); lower body supporting garment (FIGS. 10A-C); high-waisted, thonged back garment (FIGS. 11A-C); hipster waist, partial back coverage garment (FIGS. 12A-C); upper torso support (FIGS. 13A-C); and body-shaping garments including a maternity shaper or obesity body shaper (FIG. 14) and a bottomless buttock shaper (FIG. 15).

Portions of the fabric template (10) used to structure the garments are outlined. As shown in FIGS. 8A-D and FIGS. 9A-B, the bra designs incorporate the bandeau (18) and bands of the lower lift and upper sections (14, 16). The halter top of FIG. 9C incorporates bands of the lower lift section (14) and the suspender section (30). The garments of FIGS. 10A-C, 11A-C, 12A-C, 14, and 15 incorporate bands of the suspender and/or girdle sections (30, 32). The garments of FIGS. 13A-C incorporate bands within the corset section (24).

Figure 16A:
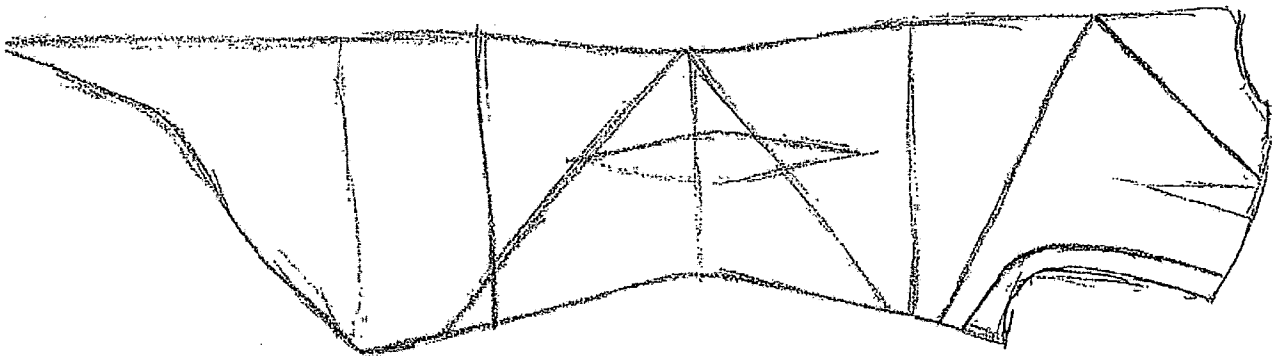
FIGS. 16A-B show basic blocks for the rear and front of a swimsuit, respectively.
Figure 16B:
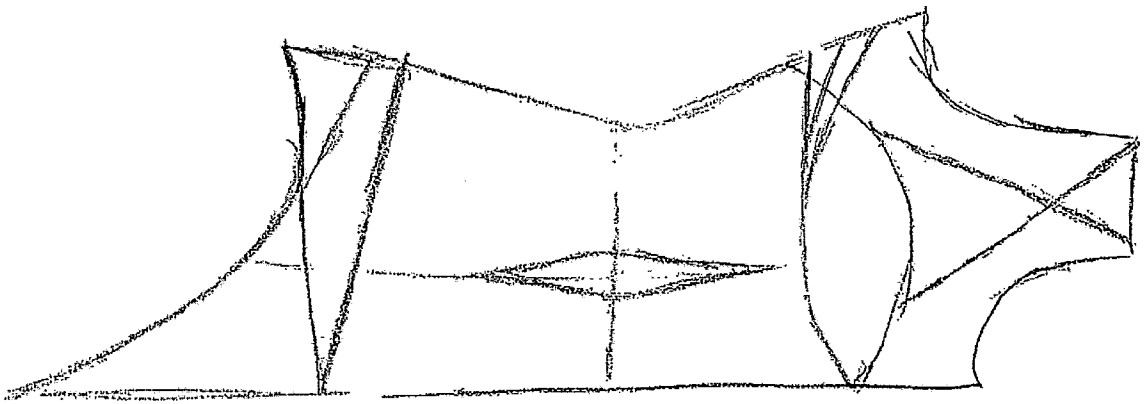
Figure 16C:
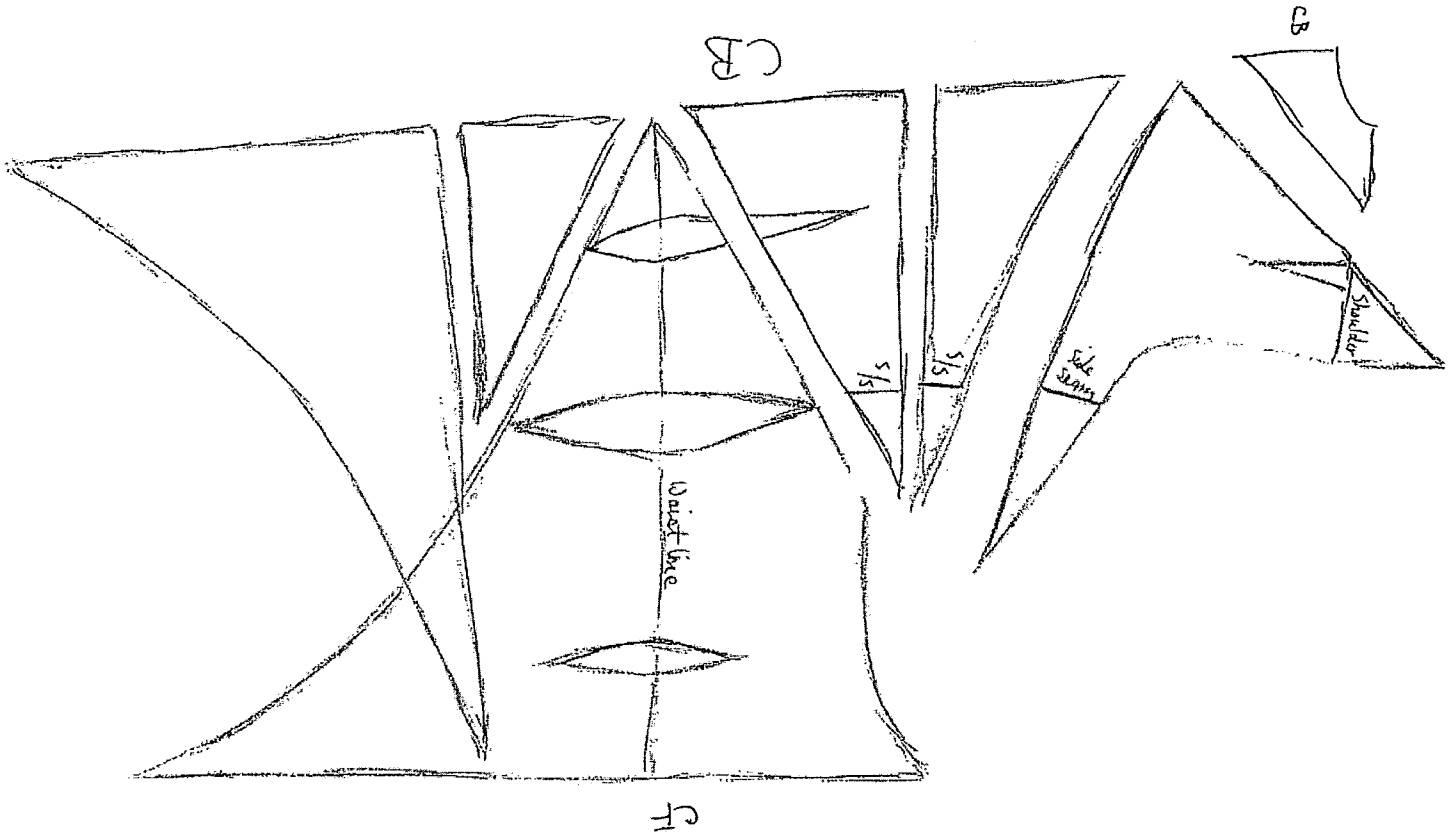
FIG. 16C shows the complete pattern pieces with seam allowance, matching notches, and pattern information.

The fabric pieces developed from the fabric template (10) can serve as foundation patterns or blocks for garments such as, for example, swimsuits. FIGS. 16A-B show basic blocks for the rear and front of a swimsuit, respectively. FIG. 16C shows the complete pattern pieces with seam allowance, matching notches, and pattern information. As used herein, the term "block" means a custom-fitted basic pattern from which patterns for many different styles can be created. The flat method can be used whereby a pattern is generated from an existing foundation pattern or block from which garment styles can be created.

Figure 17A:
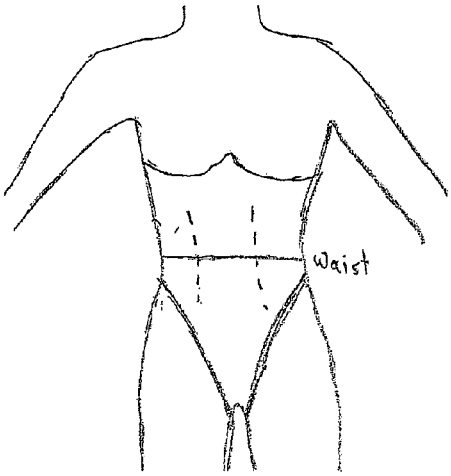
FIGS. 17A-B show basic blocks for the rear and back of a swimsuit, respectively.
Figure 17B:
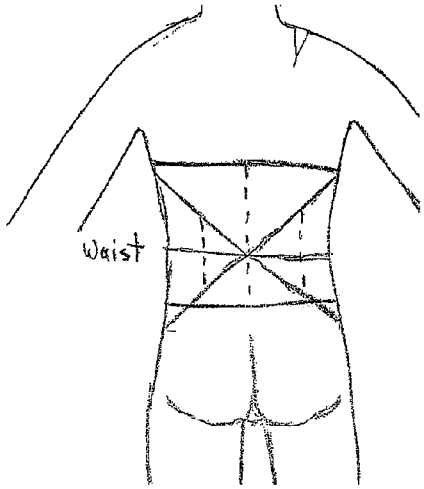
Figure 17C:
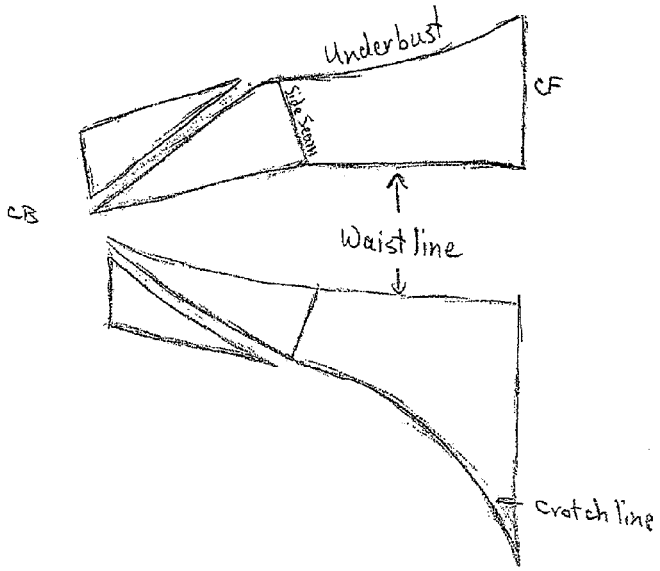
FIGS. 17C-E show complete pattern pieces with seam allowance, matching notches and pattern information to produce styles to fit different figure types including hourglass (FIG. 17C), athletic (FIG. 17D), and apple (FIG. 17E).
Figure 17D:
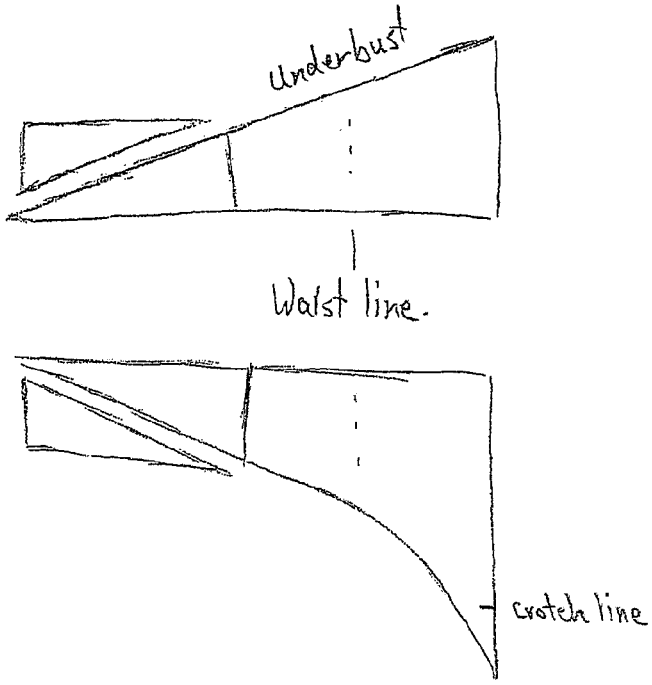
Figure 17E:
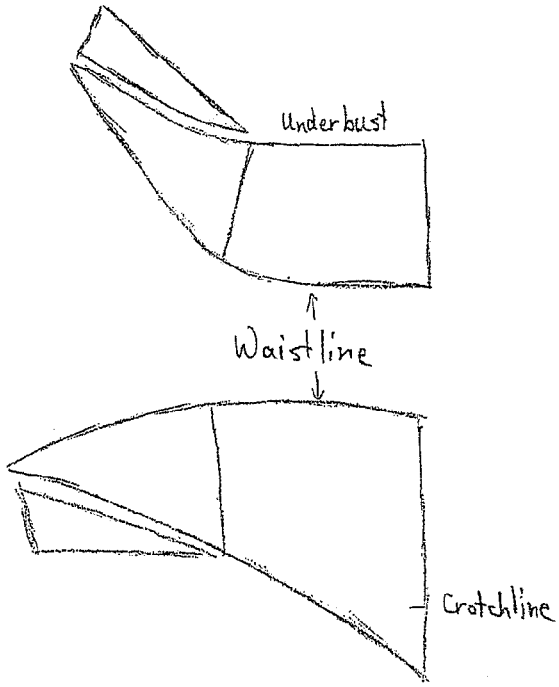

Intermediate blocks can be developed from basic blocks to enable pattern manipulation such that patterns can be produced for a variety of styles. FIGS. 17A-B show basic blocks for the front and rear of a swimsuit, respectively. FIGS. 17C-E show complete pattern pieces with seam allowance, matching notches and pattern information. Intermediate blocks developed from the basic blocks may be used to produce styles to fit different figure types including hourglass (FIG. 17C), athletic (FIG. 17D), and apple (FIG. 17E).

Figure 18A:
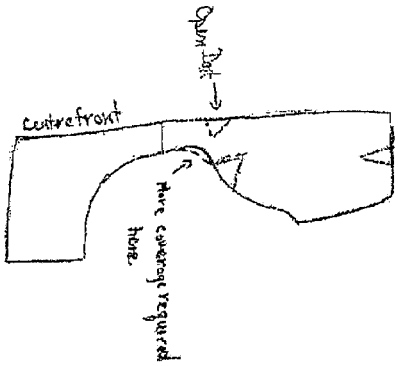
FIG. 18A (PRIOR ART)
FIG. 18A shows prior art pattern pieces for a crotchline. Figures B-E show pattern pieces for a design of a crotch for a garment.
Figure 18B:
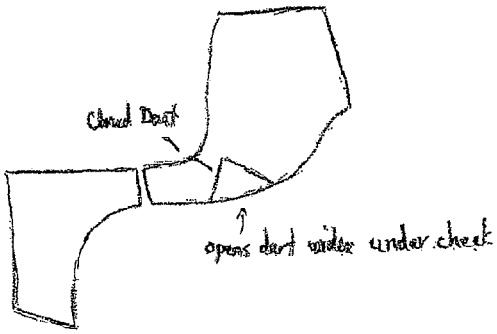
Figure 18C:
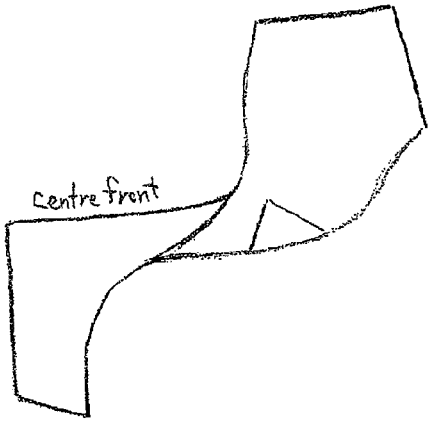
Figure 18D:
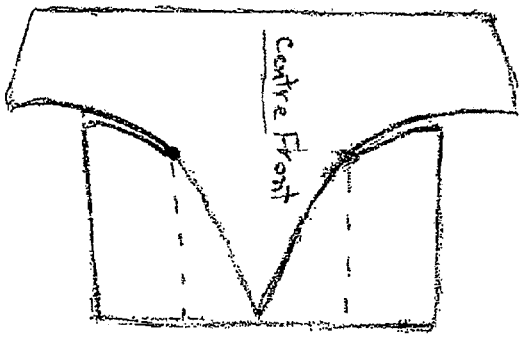
Figure 18E:
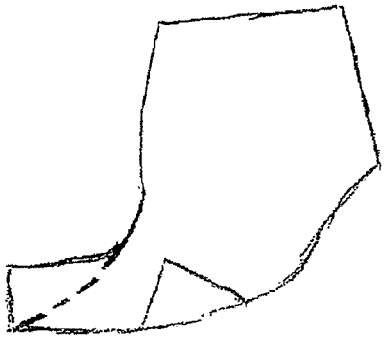

Fabric pieces can also be modified to fit specific areas of the body including, for example, the crotch. Prior art designs for classic bifurcated and panty crotchlines typically include an open dart positioned on the center frontline which can cause puckering and does not provide any option for full leg coverage (FIG. 18A). FIGS. 18B-E show an adjustable crotch extension design for length and width, which includes a closed dart on the center frontline and an open dart under the buttock.

Figure 19A:
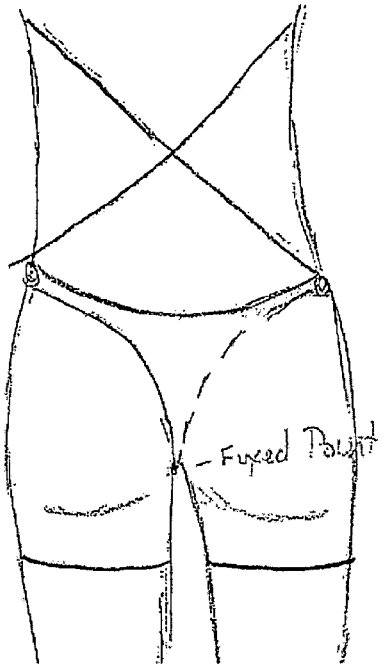
FIGS. 19A-F show openings or closures at the front (FIGS. 19B-F) or rear (FIG. 19A) of lower body garments.
Figure 19B:
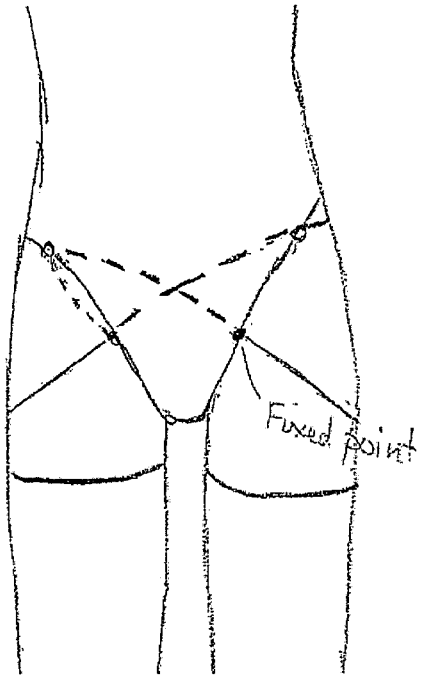
Figure 19C:
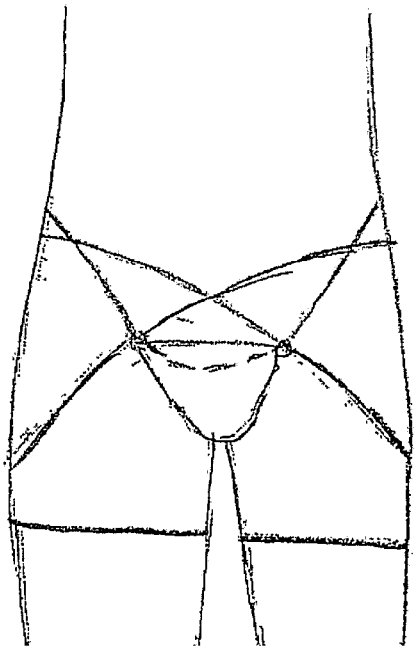
Figure 19D:
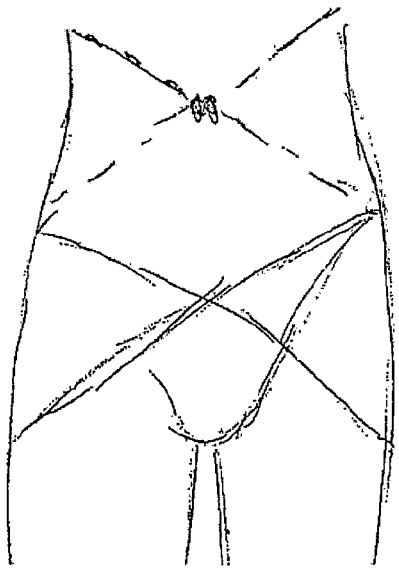
Figure 19E:
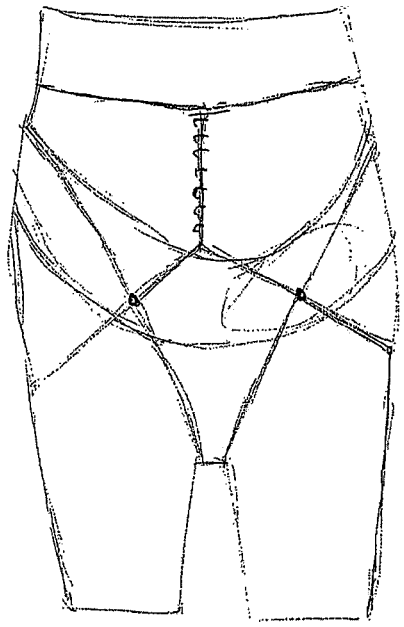
Figure 19F:
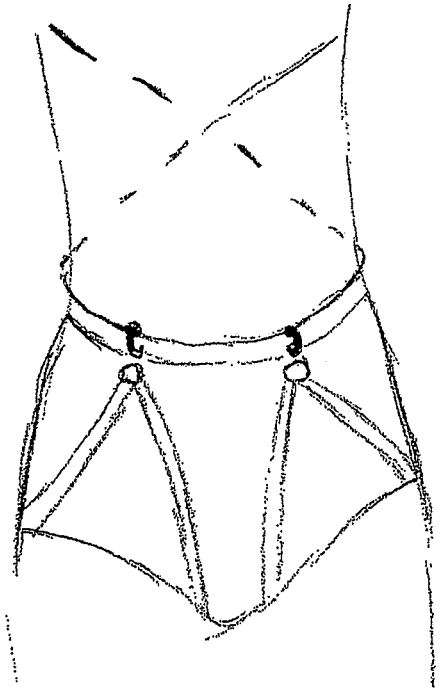
Figure 20A:
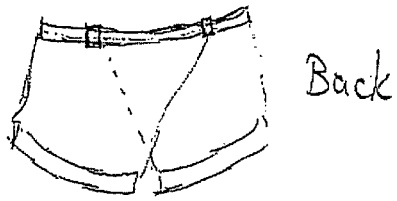
FIGS. 20A-B show openings or closures at the rear and front of a lower body garment.
Figure 20B:
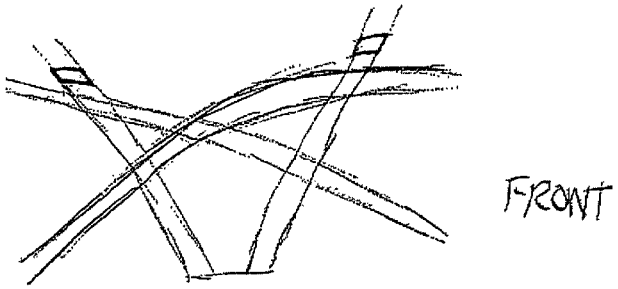
Figure 20C:
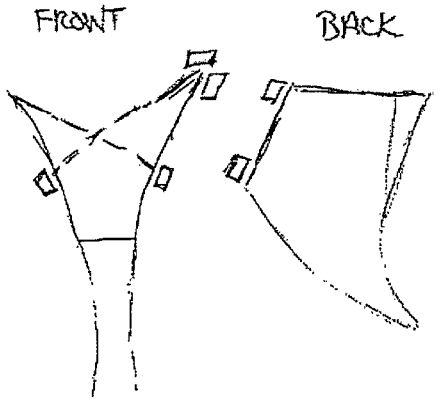
FIG. 20C shows pattern pieces used to form the garment.

Openings or closures may be positioned at the front or rear of the garment as shown, for example in the following figures: rear closure (FIG. 19A); diaper release (FIG. 19B); crotch release (FIG. 19C); clip in center back (FIG. 19D); clip in center front (FIG. 19E); connection for top to bottom (FIG. 19F); and front and back closures (FIGS. 20A-C). The positioning of openings or closures may vary depending on factors including, but not limited to, the fit, function, or style of the garment, and the wearer's preferences or physical disabilities.

In one embodiment, the invention comprises a method for preparing a garment for a wearer comprising the steps of:

a) pre-fabricating a plurality of fabric pieces in a variety of sizes, styles, and fabrics, each of the fabric pieces being structured to correspond to respective portions of the above fabric template;

b) draping fabric pieces selected according to the wearer's body contour and preferences on the wearer; and c) completing assembly of the garment.

As set forth in Example 1, the detailed steps of the method are as follows. Modular fabric pieces are pre-fabricated in a variety of sizes, styles, and functions. The fabric pieces function as blocks to form the structural base of a garment. Following a consultation with the client or wearer, the fitter selects fabric pieces in accordance to the wearer's body contour and preferences. Alternatively, the wearer may select her choices through a printed or online catalogue prior to attending the on-site fitting.

From among a selection of bandeaus having pre-determined circumferences, a bandeau (18) having the circumference of the wearer's bust is selected and fitted to the wearer's body. Suitable tools for measuring the circumference of the wearer's bust include, but are not limited to, measuring tape, metal tape, and the like. The width of the client's rib cage may provide an estimated circumference of the wearer's bust. Rib cage width can be measured by having the wearer stand with her back to a wall, marking each side of her rib cage using pegs, thumbtacks, or a pencil, and measuring the distance between the markers. The estimated circumference may vary slightly from the true circumference due to factors such as, for example, the shape of the bridge at the sternum, the height from the bridge to the top of the breast, the length of ptosis, and the depth or volume of the breasts.

After a bandeau (18) conforming substantially to the wearer's torso is fitted, the fitter drapes the fabric pieces directly onto the wearer's body. Since the fabric pieces are laid directly onto the body, the wearer has the opportunity to decide upon the desired feel of fit (i.e., tighter or looser, neckline, etc.). The fabric pieces are adjusted or altered as needed to fit the wearer. In addition, drafting fit templates may also be used in combination with the fabric pieces. As will be recognized by those skilled in the art, drafting fit templates provide individualized information as to neckline, sleeve cut, etc. Any changes to the wearer's original choices for the garment can be made during draping. In addition, there is no loss of garment details since the garment is fitted directly onto the wearer's body.

When a satisfactory fit has been achieved, the fabric pieces are pinned together. The fitter relays the details of the fabric pieces to a production operator who prepares and cuts any exterior or additional pieces required to complete assembly of the garment. With the fabric pieces provided by the production operator, the fitter finishes the fitting process on the wearer. Assembly of the garment is completed by making any needed alterations and sewing all the fabric pieces together. Any additional requirements may be included such as, for example, underwire for women having macromastia, and padding to create symmetry for a smaller breast, a lower shoulder, or a lower hip, or to enhance the size of the breasts or buttocks. In one embodiment, the garment is fitted and prepared within about four hours. In one embodiment, the garment is fitted and prepared in about 3.8 hours, including about 80 minutes for consultation and fitting, about 85 minutes for drafting and alteration, and about 65 minutes for sewing. After consultation and fitting, the garment can thus be prepared within about two and a half hours.

It will be understood that the pre-fabricated fabric pieces may be provided in a kit for fashion training or home sewing. In one embodiment, the invention comprises a kit for preparing a garment for a wearer comprising a plurality of pre-fabricated fabric pieces in a variety of sizes, styles, and fabrics, each of the fabric pieces being structured to correspond to respective portions of the fabric template, and instructions for using the fabric pieces to prepare the garment.

In one embodiment, the invention comprises a method for treating or preventing disorders associated with insufficient breast support comprising clothing a subject in a garment manufactured using the above system.

The disorders may be selected from ptosis, mastalgia, macromastia, maceration, intertrigo, muscle tension, neck pain, back pain, headaches, fatigue, upper limb neural symptoms, abrasions, poor posture, impaired circulation, shoulder strain, or breathing problems. As used herein, the term "mastalgia" means general breast pain including cyclical mastalgia with symptoms at certain timepoints in the menstrual cycle, non-cyclical mastalgia which results in consistent pain to all or part of the breast, and exercise-related mastalgia. As used herein, the term "macromastia" means a state of having disproportionately large breasts. As used herein, the term "maceration" means the softening and breaking down of skin resulting from prolonged exposure to moisture. As used herein, the term "intertrigo" means inflammation of skin folds which occurs with ptosis and macromastia.

As will be apparent to those skilled in the art, various modifications, adaptations and variations of the foregoing specific disclosure can be made without departing from the scope of the invention claimed herein.

Exemplary embodiments of the present invention are described in the following Example, which is set forth to aid in the understanding of the invention, and should not be construed to limit in any way the scope of the invention as defined in the claims which follow thereafter.

Example 1

Preparation of a Garment

A garment was prepared for a client according to the steps set out in Table 1. The time for each step was determined, with the total time for consultation/fitting being about 80 minutes, the total time for drafting/alteration being about 85 minutes, and the total time for sewing being about 65 minutes. The overall total time for preparation of the garment was 3.8 hours. These results indicate that a garment can be fitted and fabricated accurately and efficiently within less than about four hours. This preparation time is considerably less than the typical production time required for custom-made garments.

TABLE 1

| Steps for preparation of a garment | | |
|---|---|---|
| Consultation/Fitting | Drafting/Alterations | Sewing |
| | Step 1—Pre-fabrication of fabric pieces<br>20 minutes | Step 1—Pre-fabrication of fabric pieces<br>15 minutes |
| Step 2—Consultation with client (selection of fabric, style, sizing, signing of contract)<br>30 minutes | | |

TABLE 1-continued

| Steps for preparation of a garment | | |
|---|---|---|
| Consultation/Fitting | Drafting/Alterations | Sewing |
| Step 3—Fitting<br>A) Draping pre-fabricated fabric,<br>B) Fine-tune structural fit,<br>C) Finish fitting<br>D) Waiver signed by client<br>40 minutes | b) Prepare and cut fabric choice and additional pieces<br>35 minutes | c) Prepare new pieces for fitting<br>15 minutes |
| Step 4—Production finish | a) Alterations, preparation for sewing<br>30 minutes | b) Finish garment, quality check<br>35 minutes |
| Step 5—Delivery (ship out/pick up)<br>10 minutes | | |

REFERENCES

The following references are incorporated herein by reference (where permitted) as if reproduced in their entirety. All references are indicative of the level of skill of those skilled in the art to which this invention pertains.

Ashdown, S. P. and Na, H. (2008) Comparison of 3-D body scan data to quantify upper-body postural variation in older and younger women. Clothing & Textiles Research Journal 26(4):292-307.

Balit, R. (1999) Swim and body suit support system. International Publication No. WO 99/53783, published Oct. 28, 1999.

Barbu, E. (1920) Improvements in bust-supporters. GB Patent Specification No. 139,725, issued Mar. 11, 1920.

Blatt, P. (1958) Panty. U.S. Pat. No. 2,863,152, issued Dec. 9, 1958.

Bowles, K., Steele, J. R. and Chaunchaiyakul, R. (2005) Do current sports brassiere designs impede respiratory function? Medicine & Science in Sports and Exercise 1633-1640.

Bridgman, C., Scurr, J., White, J. and Hedger, W. (2008) Three dimensional kinematics of the breast during a two step star jump. Annual Conference of the British Association of Sport and Exercise Sciences 2008, Journal of Sports Sciences 26:1:S34.

Bye, E., LaBat, K. L. and DeLong, M. R. (2006) Analysis of body measurement systems for apparel. Clothing and Textiles Research Journal 24(2):66-79.

Chadwick, D. O. and Brindisi, M. K. (2001) Brassiere sizer. U.S. Pat. No. 6,276,069, issued Aug. 21, 2001.

Chapman, S. and Stewart, M. (2009) System and method of constructing and sizing brassieres. US Patent Application Publication No. 2009/0215359 A1, published Aug. 27, 2009.

Chen, C., LaBat, K. and Bye, E. (2010) Physical characteristics related to bra fit. Ergonomics 53(4):514-524.

Flanagan, P. C. (1993) Breast foundation and natural support. U.S. Pat. No. 5,215,494, issued Jun. 1, 1993.

Fox, L. Z. (2009) Breast uplift support assembly. U.S. Pat. No. 7,607,966, issued Oct. 27, 2009.

Gould, B. V. (1957) Garment. U.S. Pat. No. 2,775,767 issued Jan. 1, 1957.

Gould, B. V. (1966) Garment. U.S. Pat. No. 3,261,359, issued Jul. 19, 1966.

Grinager, H. N. and Ongley, G E. (1930) Measurement foundation garment for use in measuring the figure. U.S. Pat. No. 337,273, issued Oct. 30, 1930.

Grove, C. S. Wearable adjustable garment pattern template. U.S. Pat. No. 6,751,877, issued Jun. 22, 2004.

Hartman, K. F. (1997) Perspiration absorbent pads for female breasts. U.S. Pat. No. 5,603,653, issued Feb. 18, 1997.

Heisey, F. L., Brown, P. and Johnson, R. F. (1988) Three-dimensional pattern drafting: a theoretical framework. Clothing and Textiles Research Journal 6(3):1-9.

Ibrahim, S. M. (1968) Mechanics of form-persuasive garments based on spandex fibers. Textile Research Journal 38:950-963.

Kumai, J. and Oya, K. (1994) Garment for at least the lower body. GB Patent Application No. 2,273,646, published Jun. 29, 1994.

Lee, H., Hong, K. and Kim, E. A. (2004) Measurement protocol of women's nude breasts using a 3D scanning technique. Applied Ergonomics 35:353-359.

Loeffel, L. H. and Champagne, E. C. (1958) Controlling and measuring garment. U.S. Pat. No. 2,858,832, issued Nov. 4, 1958.

Loker, S. and Ashdown, S. (2008) Dress in the third dimension: online interactivity and its new horizons. Clothing & Textiles Research Journal 26(2):164-176.

Lustig, F. (1946) Bust separator. U.S. Pat. No. 2,406,699, issued Aug. 27, 1946.

Mason, B. R., Page, K. and Fallon, K. (1999) An analysis of movement and discomfort of the female breast during exercise and the effects of breast support in three cases. Journal of Science and Medicine in Sport 2(2):134-144.

McCall, R. (1999) Brassiere and garment incorporating a brassiere. U.S. Pat. No. 5,908,346, issued Jun. 1, 1999.

McGhee, D. E. and Steele, J. R. (2006) How do respiratory state and measurement method affect bra size calculation. Br. J. Sports Med. 40:970-974.

McGhee, D. E., Power, B. M. and Steele, J. R. (2007) Does deep water running reduce exercise-induced breast discomfort? Br. J. Sports Med. 41:879-883.

Morgan, J. L. and Powell Vreeswiijk, M. (2010) Improvements in or relating to clothing. International Publication No. WO 2010/001136, published Jan. 7, 2010.

Nabarro, D. J. N. (2001) Apparatus and method of measuring breast characteristics. GB Patent Application No. 2,355,385, published Apr. 25, 2001.

Nabarro, D. J. N. (2002) Bra measuring device and method. GB Patent Application No. 2,371,207, published Nov. 20, 2002.

Nobbs, V. L. (1967) Girdle. U.S. Pat. No. 3,339,554, issued Sep. 5, 1967.

Park, S. K., Palmer, B. M. and Ruderman, G S. (1996) Custom apparel manufacturing apparatus and method. U.S. Pat. No. 5,548,519, issued Aug. 20, 1996.

Park, S. K., Palmer, B. M. and Ruderman, G S. (1998) Custom apparel manufacturing apparatus and method. U.S. Pat. No. 5,768,135, issued Jun. 16, 1998.

Petterson, K. (2007) Method and apparatus for fitting brassieres. U.S. Pat. No. 7,164,962, issued Jan. 16, 2007.

Rhee, J. G. (2006) Posture apparatus. U.S. Pat. No. 6,991,611, issued Jan. 31, 2006.

Rhee, J. G. (2009) Posture apparatus. U.S. Pat. No. 7,578,798, issued Aug. 25, 2009.

Sawada, H. (2000) Method for manufacturing foundation garment. U.S. Pat. No. 6,101,424, issued Aug. 8, 2000.

Scurr, J., White, J. and Hedger, W. (2009) Breast displacement in three dimensions during the walking and running gait cycles. Journal of Applied Biomechanics 25:322-329.

Shin, K. (2007) Patternmaking for the underwired bra: new directions. JTI 98(4):301-317.

Steinberg, B. J. (1989) Garment measuring system. U.S. Pat. No. 4,868,990, issued Sep. 26, 1989.

Sutherland, M. (1977) Means for ascertaining required sizes of brassieres. GB Patent Specification No. 1,468,762, published Mar. 30, 1977.

Sutherland, M. (1988) Improvements in or relating to brassieres. GB Patent Application No. 2,201,579, published Sep. 7, 1988.

Valli, L. (2002) Modular brassiere fitment apparatus. U.S. Pat. No. 6,336,839, issued Jan. 8, 2002.

Versoy, I. R. (1939) Controlling bandeau. U.S. Pat. No. 2,180,180, issued Nov. 14, 1939.

Versoy, I. R. (1942) Controlling or fitting garment. U.S. Pat. No. 2,283,108, issued May 12, 1942.

Watanabe, J. S. (2006) System and method for custom-made clothing. U.S. Pat. No. 7,058,471, issued Jun. 6, 2006.

White, J. L., Scurr, J. C. and Smith, N. A. (2009) The effect of breast support on kinetics during overground running performance. Ergonomics 52(4):492-498.

Wood, K., Cameron, M. and Fitzgerald, K. (2008) Breast size, bra fit and thoracic pain in young women: a correlational study. Chiropractic & Osteopathy 16:1-7.

Yoshihara, H. (2002) Support/shape correction structure for human body and clothing structure provided therewith. EP Patent Application No. 1,179,301, published Feb. 13, 2002.

Zheng, R., Yu, W. and Fan, J. (2007) Development of a new Chinese bra sizing system based on breast anthropometric measurements. International Journal of Industrial Ergonomics 37:697-705.

What is claimed is:

1. A system for manufacturing a garment for a wearer comprising:

a) a fabric template comprising a plurality of bands which are interconnected and arranged to form a foundation, a lower lift section, and an upper lift section;

the foundation comprising a bandeau, a suspender section, a girdle section and a corset section; the bandeau comprising a breast-covering part, upper and lower edges, ends, and adjustable fastening means, and formed of an elasticized or resilient form-fitting material; and the suspender section comprising bands connecting the bandeau to the girdle section in a criss-cross pattern overlying the wearer's back; and b) a plurality of fabric pieces attachable to the template to form the garment.

2. The system of claim 1, wherein the girdle section comprises bands traversing in a criss-cross pattern overlying the wearer's front pelvic region, and extending underneath the wearer's buttocks and upwardly from between the wearer's thighs to converge with the suspender section, and bands at the top of the criss-cross pattern converging at the back of the wearer's waist.

3. The system of claim 1, wherein the corset section comprises a lower edge of the bandeau, the suspender section, and bands of the girdle section which criss-cross over the front pelvic region and converge at the back of the wearer's waist.

4. The system of claim 1, wherein the lower lift section comprises bands traversing in a criss-cross pattern overlying the wearer's upper back, and extending downwardly over the wearer's shoulders along the sides of the wearer's breasts to align substantially horizontally below the wearer's breasts.

5. The system of claim 1, wherein the upper lift section comprises bands encircling the wearer's arms and traversing in a criss-cross pattern over the wearer's sternum to isolate each of the wearer's breasts, and to extend over lower portions of the wearer's breasts.

6. The system of claim 1, wherein the garment is a brassiere, a top, a swimsuit, sportswear, a supporting garment, a body-shaping garment, or a medical garment.

7. A method for preparing a garment for a wearer comprising the steps of:

(a) pre-fabricating a plurality of fabric pieces in a variety of sizes, styles, and fabrics, each of the fabric pieces being structured to correspond to respective portions of the fabric template of claim 1;

(b) draping fabric pieces selected according to the wearer's body contour and preferences on the wearer; and (c) completing assembly of the garment.

8. The method of claim 7, wherein before step (b), a bandeau conforming substantially to the torso of the wearer is fitted.

9. The method of claim 7, wherein after step (b), the fabric pieces are adjusted to fit the wearer.

10. The method of claim 9, further comprising pinning the fabric pieces together.

11. The method of claim 7, wherein the garment is a brassiere, a top, a swimsuit, sportswear, a supporting garment, a body-shaping garment, or a medical garment.

12. The method of claim 7, wherein the garment is prepared within about four hours.

13. A method for treating or preventing disorders associated with insufficient breast support comprising clothing a subject in a garment manufactured using the system of claim 1.

14. A kit for preparing a garment for a wearer comprising a plurality of pre-fabricated fabric pieces in a variety of sizes, styles, and fabrics, each of the fabric pieces being structured to correspond to respective portions of the fabric template of claim 1, and instructions for using the fabric pieces to prepare the garment.

* * * * *